US007923913B2

(12) United States Patent
Iba et al.

(10) Patent No.: US 7,923,913 B2
(45) Date of Patent: Apr. 12, 2011

(54) IMAGE DISPLAY APPARATUS

(75) Inventors: Jun Iba, Yokohama (JP); Tomoko Narusawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 11/909,577

(22) PCT Filed: Aug. 6, 2007

(86) PCT No.: PCT/JP2007/065792

§ 371 (c)(1),
(2), (4) Date: Sep. 24, 2007

(87) PCT Pub. No.: WO2008/018608

PCT Pub. Date: Feb. 14, 2008

(65) Prior Publication Data

US 2010/0156759 A1 Jun. 24, 2010

(30) Foreign Application Priority Data

Aug. 8, 2006 (JP) ..... 2006-215856
May 17, 2007 (JP) ..... 2007-131650

(51) Int. Cl.
*H01J 1/62* (2006.01)

(52) U.S. Cl. ..... 313/495; 313/496

(58) Field of Classification Search ..... 313/495–497, 313/309, 310, 336, 351
See application file for complete search history.

(56) References Cited

U.S. PATENT DOCUMENTS

| | | | | |
|---|---|---|---|---|
| 6,140,985 | A | 10/2000 | Kanai et al. | |
| 2006/0049734 | A1 | 3/2006 | Sato et al. | 313/153 |
| 2006/0063459 | A1 | 3/2006 | Iba et al. | 445/3 |
| 2006/0164001 | A1 | 7/2006 | Iba et al. | 313/495 |
| 2007/0046173 | A1 | 3/2007 | Azuma et al. | 313/495 |

FOREIGN PATENT DOCUMENTS

| | | | |
|---|---|---|---|
| EP | 0 605 881 | A1 | 7/1994 |
| EP | 0 747 925 | A2 | 12/1996 |
| JP | 8007809 | A | 1/1996 |
| JP | 9-22673 | | 1/1997 |
| JP | 9-198003 | | 7/1997 |
| JP | 1 638 129 | A2 | 3/2006 |
| WO | WO 00/02081 | A2 | 1/2000 |

*Primary Examiner* — Vip Patel
(74) *Attorney, Agent, or Firm* — Fitzpatrick, Cella, Harper & Scinto

(57) ABSTRACT

An image display apparatus includes first and second light-emitting regions which are arranged in a first direction, a first electron-emitting device corresponding to the first light-emitting region which is located further from the second light-emitting region than the first light-emitting region with respect to the first direction, a second electron-emitting device corresponding to the second light-emitting region which is located further from the first light-emitting region than the second light-emitting region with respect to the first direction, a first black member which is located on the opposite side of the first light-emitting region from the second light-emitting region, and a second black member which is located between the first and second light-emitting regions. A width of the second black member with respect to the first direction is smaller than a width of the first black member.

20 Claims, 19 Drawing Sheets

FIG. 2A
FIG. 2B
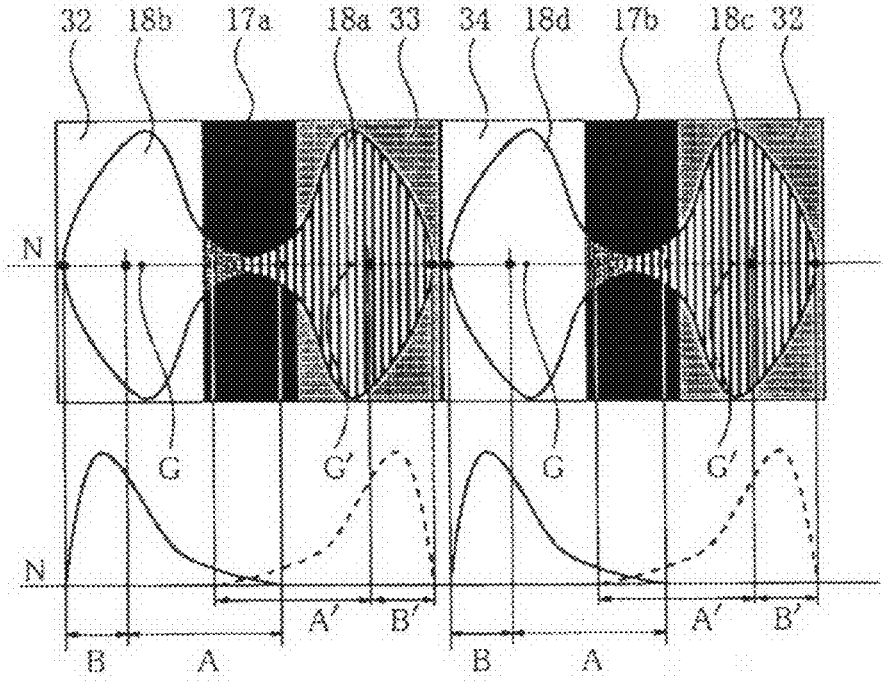
FIG. 2C
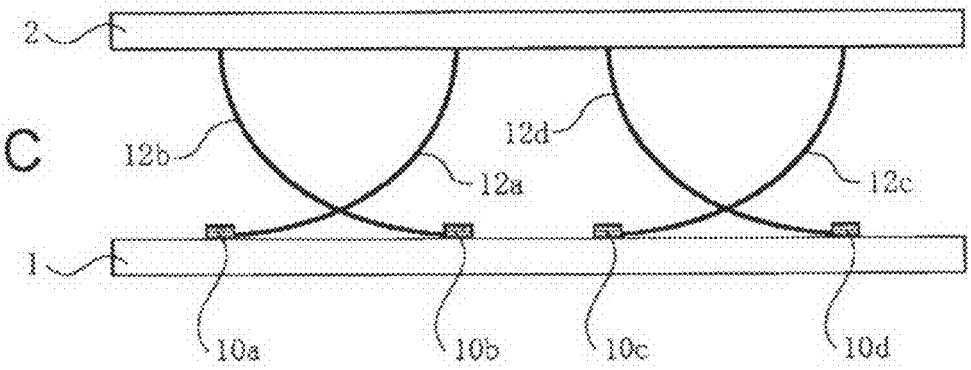

FIG. 10A
FIG. 10B
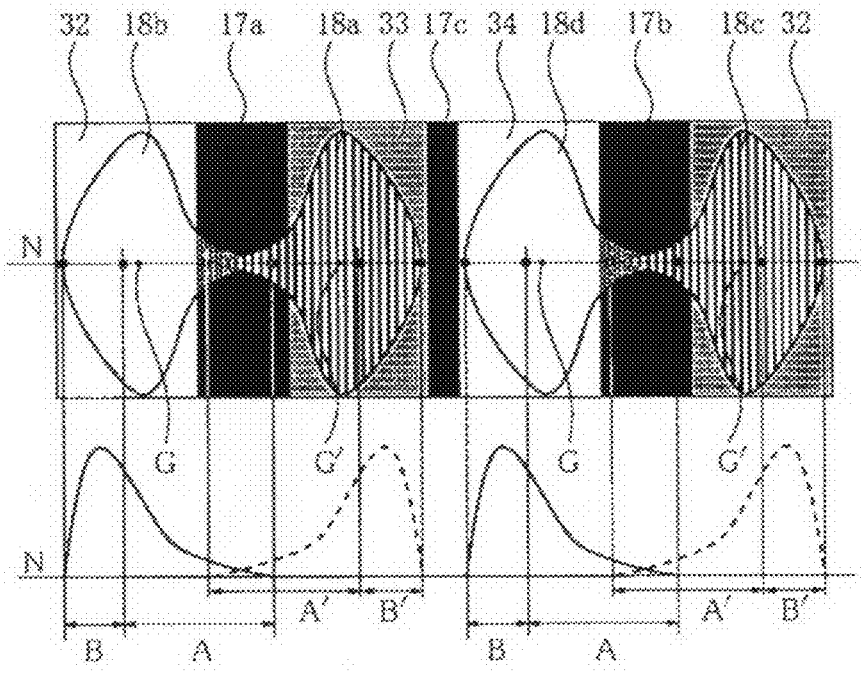
FIG. 10C
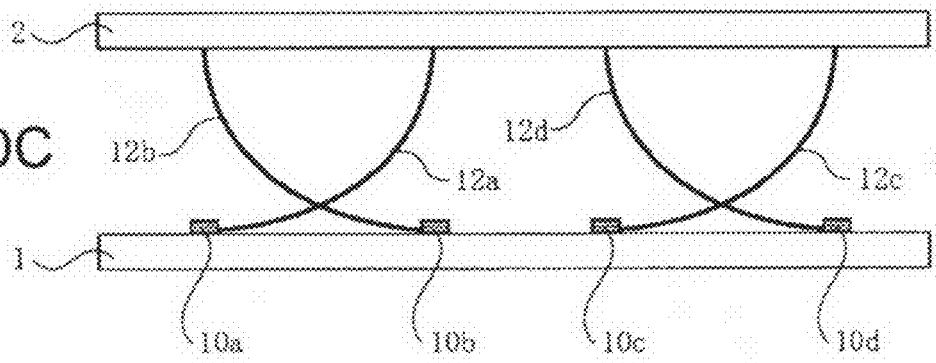

IMAGE DISPLAY APPARATUS

This Application is a National Stage filing under 35 U.S.C. §371 of International Application No. PCT/JP2007065792, filed Aug. 6, 2007.

TECHNICAL FIELD

The present invention relates to an image display apparatus, and particularly relates to arrangements of a light-emitting region and a black member of a face plate to be used in the image display apparatus.

BACKGROUND ART

Conventionally, hot cathode devices and cold cathode devices are known as two kinds of electron-emitting devices. The cold cathode devices include, for example, surface conduction electron-emitting devices, field emission type electron-emitting devices (FE type), and metal-insulator-metal type electron-emitting devices (MIM type).

FIG. 18 is a diagram illustrating a pair of an electron-emitting device and a phosphor in a display apparatus using a surface conduction electron-emitting device as a conventional example.

In the drawing, the phosphor 5 is applied to an inside of a face plate substrate 4. Conductive films 8 and 9 are sandwiched by a pair of electrodes 6 and 7, and when a voltage having not less than predetermined value is applied to the electrodes 6 and 7, electrons are emitted from an electron-emitting portion 10. The emitted electrons draw an electron trajectory 12 shown in the drawing, so that the phosphor 5 is irradiated with the electrons. Here, an acceleration voltage which accelerates the exalt ted electrons toward the phosphor 5 is denoted by Va[V]. The voltage to be applied to the electrodes 6 and 7 in order to emit the electrons is denoted by Vf[V].

In the surface conduction electron-emitting device, a voltage is applied to the electrodes 6 and 7 connected to the conductive films 8 and 9 respectively, and thus the electrons are emitted. The emitted electrons are influenced by an electric field formed by the applied voltage, and thus the phosphor 5 is irradiated with the electrons which are deflected to a high-potential electrode side and have bent trajectories. For this reason, a shape of an emitted electron spot is deformed or distorted, and thus it is difficult to obtain an axisymmetric spot such as a circular spot.

Therefore, when the surface conduction electron-emitting device is used, a shape of an electron-irradiated region (a luminescent spot) appearing on the phosphor becomes a fan shape like a luminescent spot shown in FIG. 18. The irradiation density of the electrons in the fan-shaped region is not uniform, the irradiation density is high in some portions and low in the other portions of the region.

Japanese Patent Application Laid-open Publication No. Hei 9-198003 discloses a configuration such that when one row of a phosphor is displayed, electrons are supplied from upper and lower two rows of electron-emitting portions.

In order to realize high definition by using a surface conduction electron-emitting device, Japanese Patent Application Laid-Open Publication No. Hei 9-22673 proposes a configuration where a black conductor is arranged on a region where luminance (irradiation density of electrons) is low. FIG. 19 is a diagram illustrating the configuration disclosed in Japanese Patent Application Laid-Open Publication No. Hei 9-22673.

DISCLOSURE OF INVENTION

In recent years, higher-definition image display has been required in fiat panel displays.

The present invention is devised from a viewpoint of such a problem, and provides an image display apparatus which is capable of displaying high-definition images.

An image display apparatus from a first aspect of the present invention includes:

first and second light-emitting regions which are arranged in a first direction and have different colors;

a first electron-emitting device corresponding to the first light-emitting region which is a surface conduction electron-emitting device or a lateral field-emission device and is located further from the second light-emitting region than the first light-emitting region with respect to the first direction;

a second electron-emitting device corresponding to the second light-emitting region which is a surface conduction electron-emitting device or a lateral field-emission device and is located further from the first light-emitting region than the second light-emitting region with respect to the first direction;

a first black member which is located on the opposite side of the first light-emitting region from the second light-emitting region; and a second black member which is arranged between the first and second light-emitting regions, wherein width of the second black member with respect to the first direction is smaller than a width of the first black member.

An image display apparatus from a second aspect of the present invention includes:

first and second light-emitting regions which are arranged in a first direction and have different colors;

a first electron-emitting device corresponding to the first light-emitting region which is a surface conduction electron-emitting device or a lateral field-emission device and is located further from the second light-emitting region than the first light-emitting region with respect to the first direction;

a second electron-emitting device corresponding to the second light-emitting region which is a surface conduction electron-emitting device or a lateral field-emission device and is located further from the first light-emitting region than the second light-emitting region with respect to the first direction; and a first black member which is located on the opposite side of the first light-emitting region from the second light-emitting region, wherein the first and second light-emitting regions are directly adjacent with no black member therebetween.

An image display apparatus from a third aspect of the present invention includes:

a face plate;

first and second light-emitting regions which are arranged on the face plate in a first direction and have different colors;

first and second electron-emitting devices corresponding to the first and second light-emitting regions respectively;

a first black member which is located on the opposite side of the first light-emitting region from the second light-emitting region; and a second black member which is located between the first and second light-emitting regions, wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, a centroid and an electron-density-weighted center of the first electron-irradiated region are in different positions along the first direction, a centroid and an electron-density-weighted center of the second electron-irradiated region are in different positions along the first direction, high electron-density sides of the first and second electron-irradiated regions face each other; and a width of the second black member with respect to the first direction is smaller than a width of the first black member.

An image display apparatus from a fourth aspect of the present invention includes:

a face plate;

first and second light-emitting regions which are arranged on the face plate in a first direction and have different colors;

first and second electron-emitting devices corresponding to the first and second light-emitting regions respectively; and a first black member which is located on the opposite side of the first light-emitting region from the second light-emitting region;

wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, a centroid and an electron-density-weighted center of the first electron-irradiated region are in different positions along the first direction, a centroid and an electron-density-weighted center of the second electron-irradiated region are in different positions along the first direction, high electron-density sides of the first and second electron-irradiated regions face each other; and the first and second light-emitting regions are directly adjacent with no black member therebetween.

An image display apparatus from a fifth aspect of the present invention includes:

a face plate;

first, second and third light-emitting regions which are arranged on the face plate in a circular form and have different colors;

first, second and third electron-emitting devices corresponding to the first, second and third light-emitting regions respectively; and a black member which is located at a center of the first, second and third light-emitting regions;

wherein a first electron-irradiated region is formed on the face plate by irradiation with electrons emitted toward the first light-emitting region from the first electron-emitting device, a second electron-irradiated region is formed on the face plate by irradiation with electrons emitted toward, the second light-emitting region from the second electron-emitting device, a third electron-irradiated region is formed on the face plate by irradiation with electrons emitted toward the third light-emitting region from the third electron-emitting device, a centroid and an electron-density-weighted center of the first electron-irradiated region are in different positions along a direction radial about the black member, a centroid and an electron-density-weighted center of the second electron-irradiated region are in different positions along a direction radial about the black member, a centroid and an electron-density-weighted center of the third electron-irradiated region are in different positions along a direction radial about the black member, and the black member is located on low electron-density sides of the first, second and third electron-irradiated regions.

According to the present invention, the image display apparatus which enables display of high-definition images can be provided.

Further features of the present invention will become apparent from the following description of exemplary embodiments with reference to the attached drawings.

BRIEF DESCRIPTION OF DRAWINGS

FIG. 2A is a diagram illustrating a positional relationship among light-emitting members and black members and electron-irradiated regions according to a first embodiment, FIG. 2B is a diagram illustrating electron density distribution along a line N, and FIG. 2C is a diagram illustrating electron-emitting devices and its electron trajectories;

FIG. 10A is a diagram illustrating a positional relationship among light-emitting members and black members and electron-irradiated regions according to a second embodiment, FIG. 10B is a diagram illustrating electron density distribution along a line N; and FIG. 10C is a diagram illustrating electron-emitting devices and its electron trajectories;

DESCRIPTION OF LETTERS OR NUMERALS

1: rear plate
2: face plate
10*a* to 10*d*: electron-emitting device
17*a* to 17*c*: black member
18*a* to 18*d*: electron-irradiated region
32 to 34: light-emitting member
C: electron-density-weighted center
G, G': centroid of electron-irradiated region

BEST MODE FOR CARRYING OUT THE INVENTION

Preferred embodiments of an image display apparatus of the present invention are described.

First Embodiment

An irradiated region and density distribution of electrons to be emitted from a surface conduction electron-emitting device to be used in the first embodiment are described.

Figure 18:
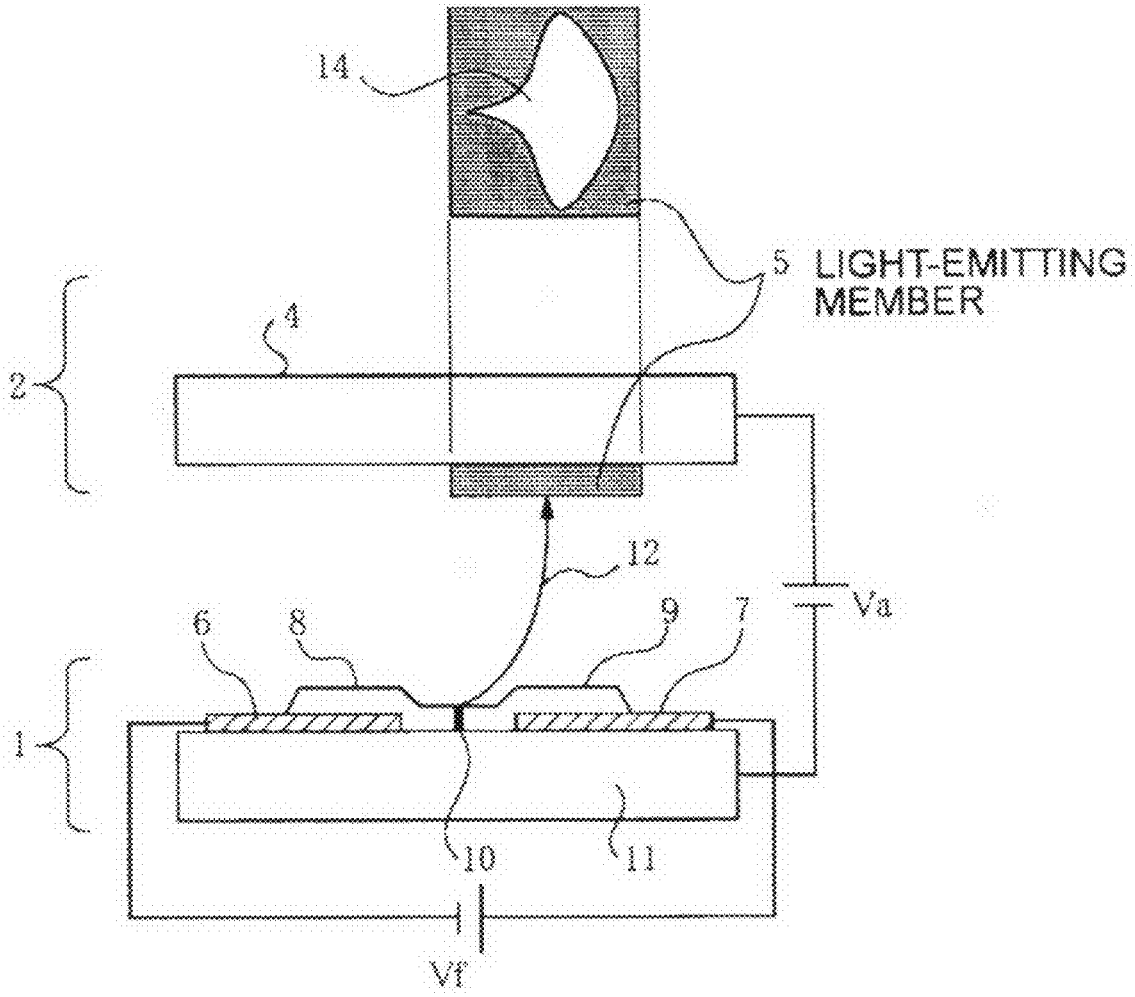
FIG. 18 is a diagram illustrating an electron-emitting device and a phosphor according to a conventional example.
Figure 19A:
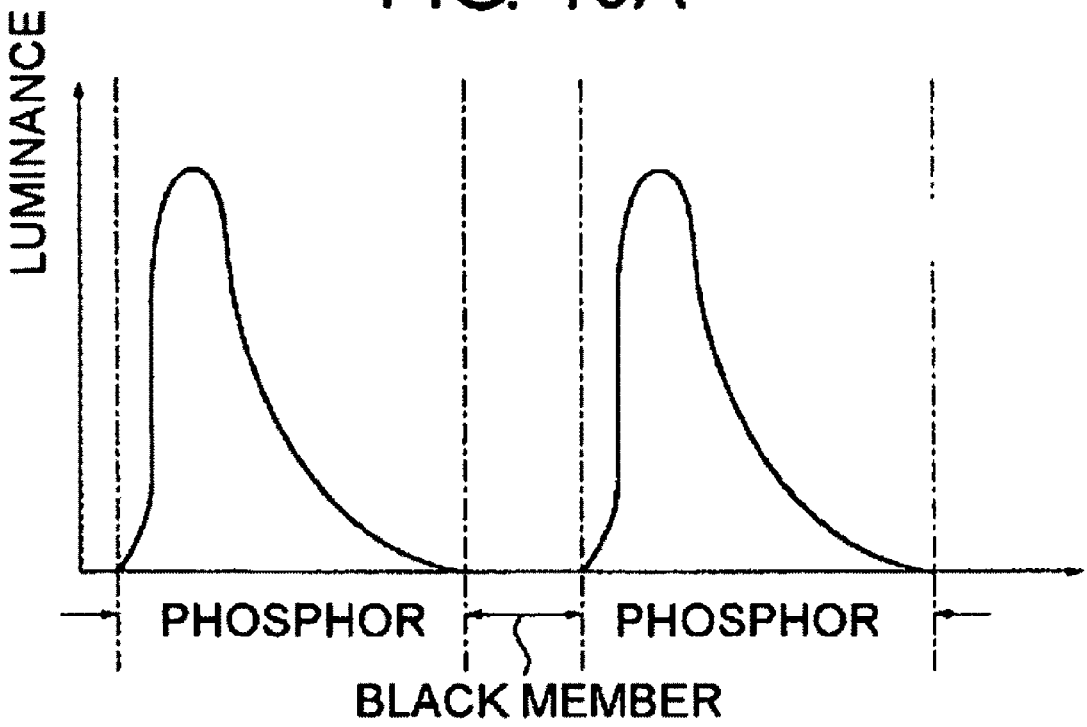
FIG. 19 is a diagram illustrating luminance distribution on the phosphor according to the conventional example.
Figure 19B:
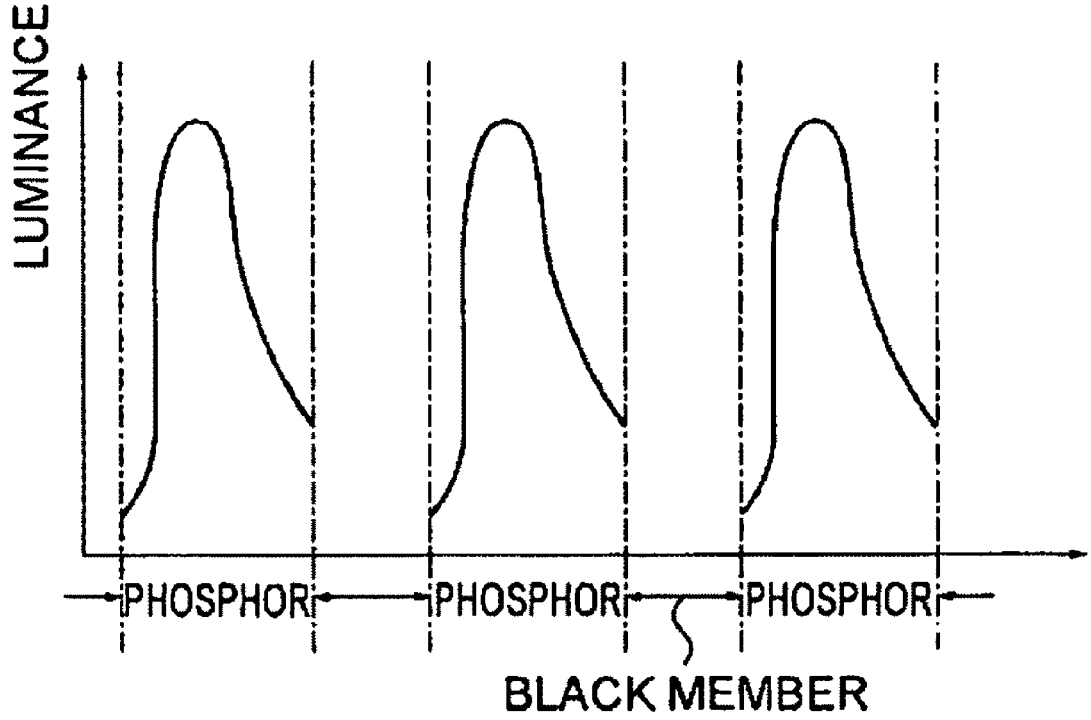

FIG. 18 is a configuration diagram illustrating the surface conduction electron-emitting device arranged on a rear plate 1 and a face plate 2. In FIG. 18, 4 denotes a face plate substrate, 5 denotes a light-emitting member, 6 and 7 denote electrodes, 8 and 9 denote conductive films, 10 denotes an electron-emitting portion, 11 denotes a rear plate substrate, and 12 denotes an electron trajectory. A predetermined acceleration voltage Va is applied between the rear plate 1 and the face plate 2. A pulse voltage Vf is applied between the electrodes 6 and 7. A higher potential than that of the electrode 6 is applied to the electrode 7. Electrons are emitted from the electron-emitting portion 10 between the conductive films 8 and 9 according to the pulse voltage Vf. The light-emitting member 5 is irradiated with electrons so as to emit predetermined visible light. As shown by the electron trajectory 12, the electron trajectory of the surface conduction electron-emitting device is drawn so as to translate from a negative potential to a positive potential. Non-uniform electron density distribution is generated along the translational direction of the electron trajectory.

Figures 1A, 1B:
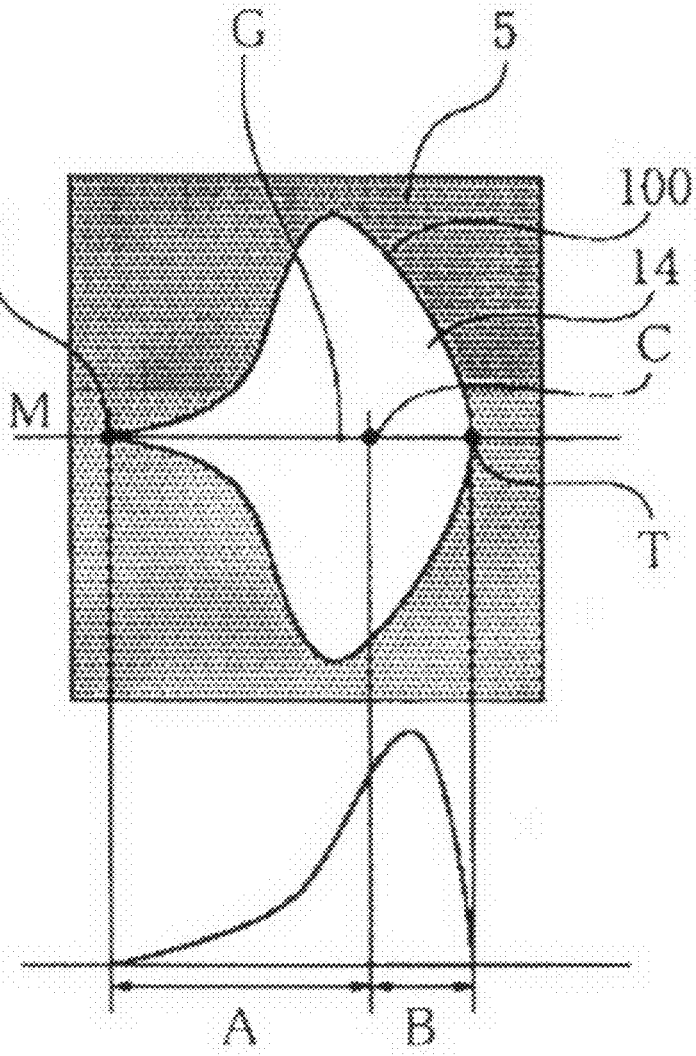
FIG. 1A is a diagram illustrating an electron-irradiated region on a surface of a light-emitting member.
FIG. 1B is a diagram, illustrating electron-density distribution along a line M.

FIG. 1A illustrates an example of an electron-irradiated region 14 on the surface of the light-emitting member 5. The light-irradiated region of the present invention is a region which is surrounded by a profile line 100 where electron-irradiation density (electron density) is 1% on the basis of the maximum value of the electron-irradiation density. In the first embodiment, the electron-irradiated region 14 is formed into a fan shape in the translational direction of the electron trajectory 12 by an electric field formed by the acceleration voltage Va and the pulse voltage Vf. The region 14 is approximately symmetrical with respect to the direction vertical to the translational direction. Light-emitting luminance distribution of the light-emitting member 5 at the time when the electron-irradiated region 14 is irradiated with electrons is approximately similar to the electron density distribution of the electron-irradiated region 14 in the case of a phosphor to be normally used.

An electron-density-weighted center of the electron-irradiated region 14 is denoted by C. A line M which passes through the electron-density-weighted center C and is parallel with the translational direction of the electron trajectory is defined, and intersection points between the line M and the profile line 100 are end points S and T. That is to say, the end points of the electron-irradiated region mean intersections between the line passing through the electron-density-weighted center C and crossing the electron-irradiated region 14 and the profile line 100 of the electron-irradiated region 14. In the first embodiment, the profile line 100 is defined as a region where the electron-irradiation density is 1% on the basis of the maximum value of the electron-irradiation density in the electron-irradiated region 14. A point G in the FIG. 1A is a geometric centroid of the electron-irradiated region 14.

FIG. 1B illustrates the electron density distribution on the line M. A line segment which connects the points S and C is a line segment A, and a line segment which connects the points C and T is a line segment B. As is clear from FIG. 1B, the line segment A is longer than the line segment B. The electron-irradiation density distribution included in the line segment A changes more gently.

FIG. 2A shows an arrangement for reducing a pixel pitch in a configuration where a plurality of surface conduction electron-emitting devices are arranged and black members are provided. FIG. 2A is a configuration diagram illustrating the face plate 2 and the electron-irradiated regions 18*a* to 18*d* in the first embodiment. In FIG. 2A, 32 to 34 denote light-emitting members, and colors of the adjacent light-emitting members are different from each other. 17*a* and 17*b* denote black members, and 18*a* to 18*d* denote electron-irradiated regions which are irradiated with electrons emitted from the electron-emitting devices 10*a* to 10*d*.

FIG. 2B is a diagram illustrating the electron density distribution on the line N of FIG. 2A. Similarly to FIG. 1A, line segments which connect the electron-density-weighted center and the end points are defined. The line segments A and B are defined on the electron-irradiated regions 18*b* and 18*d* formed by the electrons emitted from the electron-emitting devices 10*b* and 10*d*. Similarly, line segments A' and B' are defined on the electron-irradiated regions 18*a* and 18*c* formed by the electrons emitted from the electron-emitting devices 10*a* and 10*c*. In this case, relationships: A>B and A'>B' are established.

First and second electron-emitting devices in the first embodiment are described with reference to FIG. 2C. In the first embodiment, the electron-emitting device 10*a* corresponds to the first electron-emitting device, and the electron-emitting device 10*d* corresponds to the second electron-emitting device. The electrons emitted from the first electron-emitting device 10*a* and the second electron-emitting device 10*d* reach the face plate 2 with trajectories shown by 12*a* and 12*d* respectively.

In the first embodiment, the light-emitting member 33 corresponds to a "first light-emitting region", and the light-emitting member 34 corresponds to a "second light-emitting region" (hereinafter, the first light-emitting member 33 and the second light-emitting member 34). The first and second light-emitting members 33 and 34 are arranged on the face plate 2 and have different colors. The direction where the first and second light-emitting members 33 and 34 are arranged is defined as a "first direction". In the configuration shown in FIGS. 2A to 2C, the first direction is substantially parallel with the line N, and practically matches with the direction where the first and second electron-emitting devices 10*a* and 10*d* are arranged. The first electron-emitting device 10*a* corresponding to the first light-emitting member 33 is located further from the second light-emitting member 34 than the first light-emitting member 33 with respect to the first direction. On the other hand, the second electron-emitting device 10*d* corresponding to the second light-emitting member 34 is located further from the first light-emitting member 33 than the second light-emitting member 34 with respect to the first direction, "With respect to the first direction" means that "in the case of comparing orthogonal projections to a linear line along the first direction". Positions of the geometric centroids of the light-emitting members (light-emitting regions) are considered as the positions of the light-emitting members. The positions of the electron-emitting portions (sufficiently smaller than the light-emitting members) are considered as the positions of the electron-emitting devices.

The electrons emitted from the first electron-emitting device 10*a* to the first light-emitting member 33 form the first electron-irradiated, region 18*a* on the face plate 2. The electrons emitted from the second electron-emitting device 10*d* to the second light-emitting member 34 form the second electron-irradiated region 18*d* on the face plate 2. The first centroid G' as the geometric centroid of the first electron-irradiated region 18*a* and the second centroid G as the geometric centroid of the second electron-irradiated region 18*d* are positioned between the first and second electron-emitting devices 10*a* and 10*d* with respect to the first direction. That is to say, as shown in FIGS. 2A to 2C, when orthogonal projection to the linear line N along the first direction is considered, the first electron-emitting device 10*a*, the first centroid G', the second centroid G and the second electron-emitting device 10*d* are arranged in this order.

As is clear from FIG. 2C, a distance from the first centroid G' to the first electron-emitting device 10*a* is shorter than a distance from the first centroid G' to the second electron-emitting device 10*d*.

In the first embodiment, the black member is not disposed between the first and second light-emitting members 33 and 34. That is to say, the first and second light-emitting members 33 and 34 are adjacent directly with nothing therebetween. A black member (corresponding to the "first black member" of the present invention) 17*a* is located on the opposite side of the first light-emitting member 33 from the second light-emitting member 34. The black member 17*a* is arranged so as to overlap the end of the first electron-irradiated region 18*a*. A black member 17*b* is located on the opposite side of the second light-emitting member 34 from the first light-emitting member 33. The black member 17*b* is disposed so as to overlap the end of the second electron-irradiated region 18*d*.

The embodiment of the present invention is described in more detail below.

Figure 3:
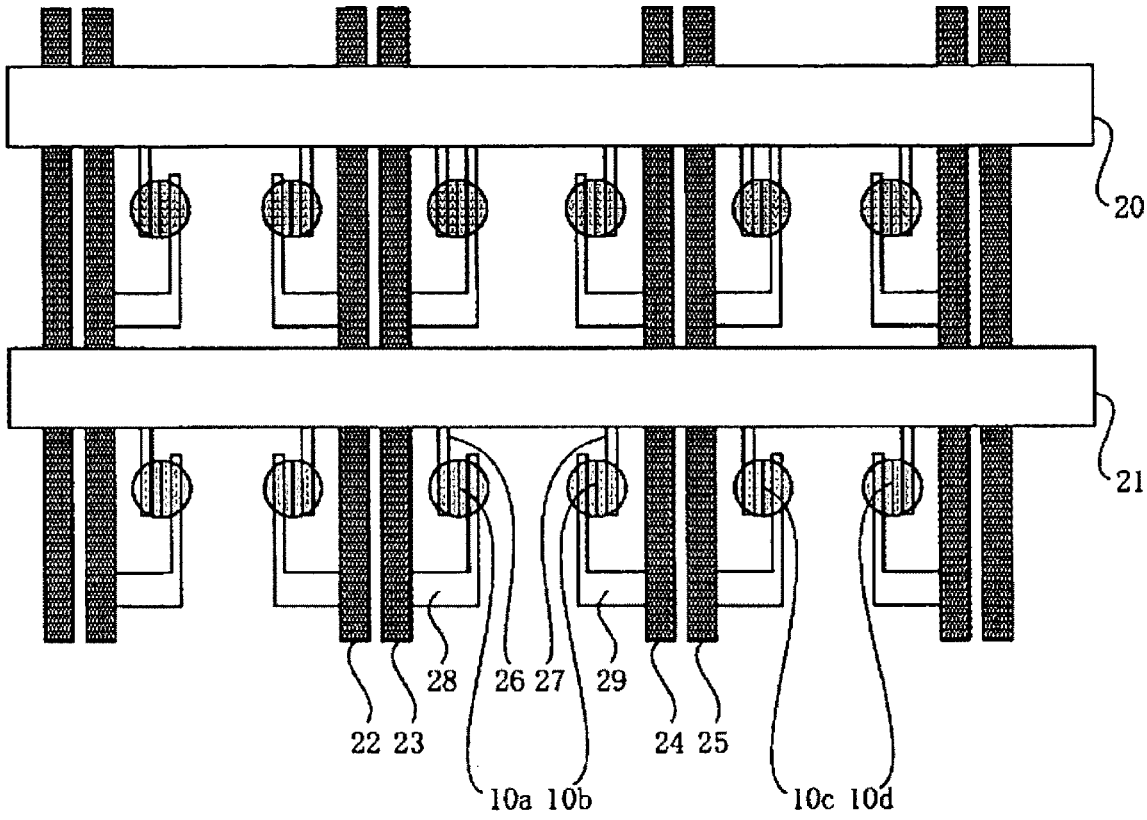
FIG. 3 is a diagram illustrating a configuration of a rear plate according to the first embodiment.

FIG. 3 illustrates the surface conduction electron-emitting devices arranged on the rear plate for matrix driving. In FIGS. 3, 20 and 21 denote scan signal wirings, 22 to 25 denote information signal wirings, and 26 and 27 denote scan signal electrodes, 28 and 29 denote information signal electrodes, and 10*a* to 10*d* denote electron-emitting portions (electron-emitting devices) of the surface conduction electron-emitting devices. In FIG. 3, the numerals of the similar members are omitted. As not shown, but an insulating layer which prevents short circuit is provided between the scan signal wirings 20 and 21 and the information signal wirings 22 to 25. A scan signal for selecting each line is applied to the scan signal wirings 20 and 21, and an information signal representing display information of each pixel is applied to the information signal wirings 22 to 25 so that each pixel is selected. A voltage is applied to the electron-emitting portions 10*a* to 10*d* via the scan signal electrodes 26 and 27 and the information signal electrodes 28 and 29, so that the electrons are emitted from the respective pixels. A higher electric potentials than that of the scan signal electrodes 26 and 27 is applied to the information signal electrodes 28 and 29 at the time of electron emission.

Figure 4:
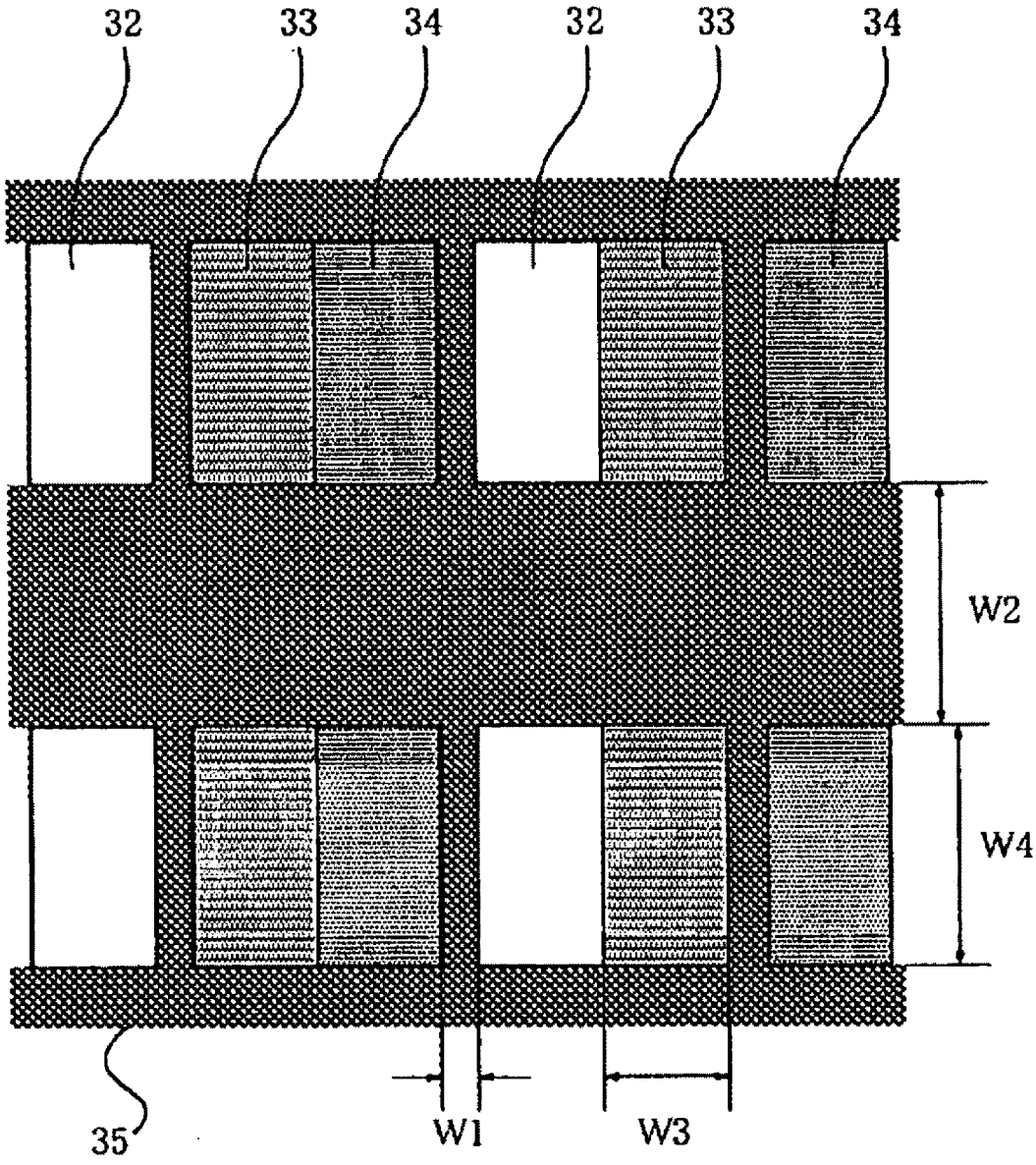
FIG. 4 is a diagram illustrating a configuration, of a face plate according to the first embodiment.

FIG. 4 illustrates a configuration of the face plate arranged so as to be opposed to the rear plate provided with the electron-emitting devices shown in FIG. 3. In FIG. 4, 32 to 34 denote the light-emitting members, and 35 denotes the black member. The light-emitting members 32 to 34 compose pixels with different colors respectively. In the first embodiment, since color images are displayed, red, green and blue phosphors to be used in the field of CRT are used for the portions of the light-emitting members 32 to 34. The phosphors with uniform color are arranged in a column direction (Y direction).

The black member 35 is arranged so that the light-emitting members and the respective pixels in the Y direction are separated from each other, respectively. The black member 35 has not only a function for absorbing electrons but also a function for reducing screen reflection by absorbing external light.

In the first embodiment, the black member 35 is present between the light-emitting members 32 to 34 of different colors in some regions but is not present in the other regions. A width W1 of the region in a row direction (X direction) where the black member 35 is present is 50 μm. A width W2 in the column direction (Y direction) is 300 μm. A width W3 of the light-emitting members 32 to 34 in the X direction is 150 μm, and a width W4 of the light-emitting members 32 to 34 in the Y direction is 300 μm. In the first embodiment, the pitch of one set of red, green and blue light-emitting members in the X direction is 525 μm.

Figure 5:
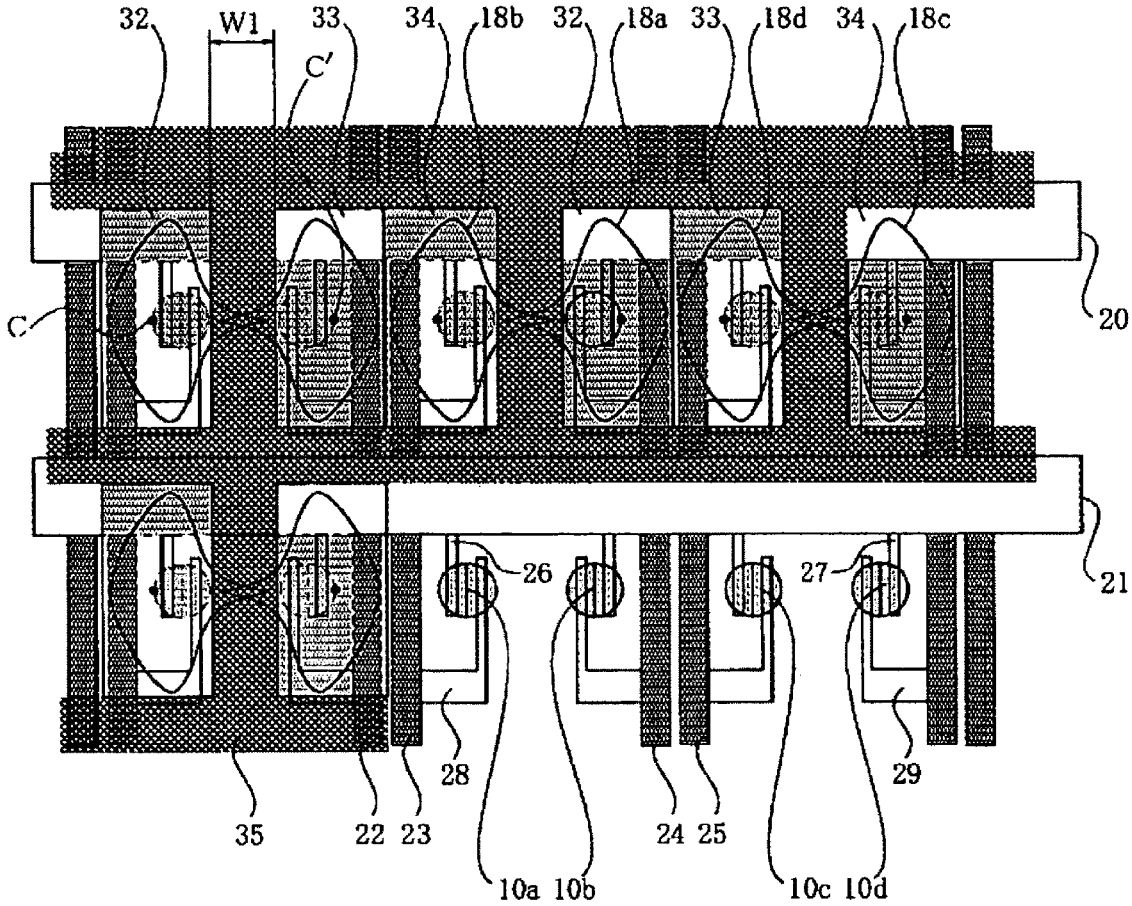
FIG. 5 is a diagram illustrating the configurations of the rear plate and the face plate according to the first embodiment.

FIG. 5 is a diagram, where FIGS. 3 and 4 are overlapped, illustrating the electron-irradiated regions 18*a* to 18*d* to be formed by electrons emitted from the surface conduction electron-emitting devices of FIG. 3. The electron-irradiated regions 18*a* to 18*d* are equivalent to the electron-irradiated regions 18*a* to 18*d* of FIG. 2. C and C' denote the electron-density-weighted centers of the electron-irradiated regions. The light-emitting members 32 to 34 are light-emitting members of different colors. In FIG. 5, positions which are shifted by one row in the illustration are denoted by letters and numerals, but the electron-irradiated regions 18*a* to 18*d* are formed on the same row by the electrons emitted from the electron-emitting devices 10*a* to 10*d*. The electron-irradiated region 18*a* of the electron-emitting device 10*a* is formed above the adjacent electron-emitting device 10*b* in the vertical direction. On the contrary, the electron-irradiated region 18*b* of the electron-emitting device 10*b* is formed above the electron-emitting device 10*a* in the vertical direction. That is to say, the trajectories of the electrons emitted from the electron-emitting devices 10*a* and 10*b* cross in a space. Similarly, the trajectories of the electrons emitted from the electron-emitting devices 10*c* and 10*d* cross in a space.

On the low electron-density sides of the electron-irradiated regions 18*a* and 18*b* face each other and overlap on the black member 35. Similarly, the low electron-density sides of the electron-irradiated regions 18*c* and 18*d* face each other and overlap on the black member 35. On the other hand, the black member is not present between the light-emitting members 32 and 33 corresponding to the electron-irradiated regions 18*a* and 18*d*, so that the light-emitting members 32 and 33 are adjacent to each other.

In the first embodiment, the centroid (geometric center) and the electron-density-weighted center of the first electron-irradiated region 18*a* are in different positions along the first direction (X direction). The centroid (geometric center) and the electron-density-weighted center of the second electron-irradiated region 18*d* are in different positions along the first direction (X direction). In other words, in the first embodiment, the electron-density-weighted center of the first electron-irradiated region 18*a* and the electron-density-weighted center of the second electron-irradiated region 18*d* are in positions which shift to a direction where they come close to each other from the geometric centers of the electron-irradiated regions 18*a* and 18*d*, respectively. The high electron-density side of the first electron-irradiated region 18*a* (corresponding to a region B' in FIG. 2B) and the nigh electron-density side of the second electron-irradiated region 18*d* (corresponding to a region B in FIG. 2B) face each other. The black member is not disposed between the first light-emitting member 33 corresponding to the first electron-irradiated region 18*a* and the second light-emitting member 34 corresponding to the second electron-irradiated region 18*d* (see FIG. 2A). The black members 17*a* and 17*b* are disposed on the low electron-density side of the first electron-irradiated region 18*a* (corresponding to a region A' in FIG. 2B) and the low electron-density side of the second electron-irradiated region 18*d* (corresponding to a region A in FIG. 2B), respectively (see FIG. 2A).

The black member is not disposed between the light-emitting member 33 positioned on the electron-irradiated region 18*a* and the light-emitting member 34 positioned on the electron-irradiated region 18*d*. As a result, the black member for the width W1 is not required, and the pixel pitch can be reduced accordingly, so that high definition is achieved.

In a method of measuring the electron density distribution in the electron-irradiated regions, an electron current measuring system using a Faraday cup can be used. Since the electron density distribution is approximately similar to the light-emitting luminance distribution of the phosphors, a method of measuring the light-emitting luminance distribution of the phosphors using a CCD camera may be used. Particularly when the light-emitting luminance distribution of the phosphors is measured by the CCD camera, a thin film type phosphor in which scattering of electrons is less is desirably used.

The above description refers to the electron-emitting devices 10*a* and 10*d* as the first and second electron-emitting devices. However, in FIG. 5 for example, the black member is not necessary between the light-emitting member 34 on the electron-irradiated region 18*b* and the light-emitting member 33 of different color adjacent to the light-emitting member 34 on the left side. For this reason, when the third electron-emitting device on the left side from the electron-emitting device 10*b* in the drawing is determined as the first electron-emitting device, the electron-emitting device 10*b* becomes the second electron-emitting device. Much the same is true on the other electron-emitting devices including the electron-emitting device 10*c*. In the first embodiment, the light-emitting member corresponding to the first electron-emitting device is the first light-emitting member (light-emitting region), and the light-emitting member corresponding to the second electron-emitting device is the second light-emitting member (light-emitting region).

When even one portion which does not require the black member is present, a higher-definition image can be displayed in comparison with a conventional technique. In order to enable the display of higher-definition images, it is preferable that a plurality of the pairs of the first and second light-emitting members is arranged in the first direction (the row direction in the first embodiment) with no other light-emitting members. In the example of FIG. 5, the pair of the light-emitting members 33 and 34 is arranged on the left side of the pair of the light-emitting members 32 and 33 corresponding to the electron-emitting devices 10*a* and 10*d*. Only the black member of width W1 is arranged between the two pairs. In other words, it is preferable that the first light-emitting members (for example, the light-emitting members 32 and 34 on the positions of the electron-irradiated regions 18*a* and 18*c*) and the second light-emitting members (for example, the light-emitting members 34 and 33 on the positions of the electron-irradiated regions 18*b* and 18*d*) are arranged alternatively along the first direction (the row direction in the first embodiment).

Figure 6A:
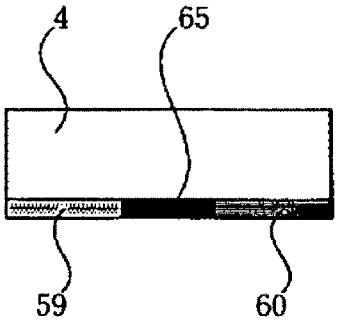
FIGS. 6A to 6C are diagrams illustrating configurations of the light-emitting members and the black members of the present invention.
Figure 6B:
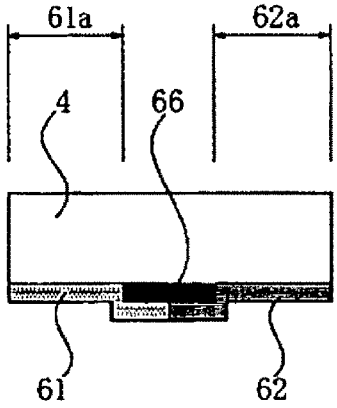
Figure 6C:
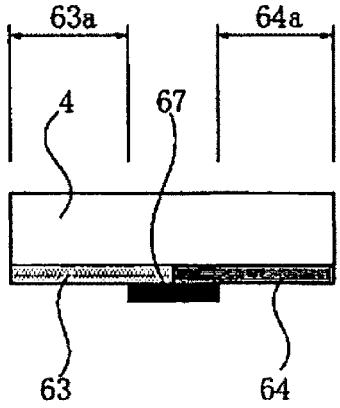

As the configurations of the light-emitting members and the black members, there are some forms shown in FIGS. 6A to 6C. In FIGS. 6A to 6C, 4 denotes the face plate substrate, 59 to 64 denote the light-emitting members, and 65 to 67 denote the black members. In FIG. 6A, the light-emitting members 59 and 60 and the black member 65 are formed without overlapping on the face plate. In FIG. 6B, the light-emitting members 61 and 62 are formed also on the black member 66. In FIG. 6C, the black member 67 is formed on the light-emitting members 63 and 64. When these configurations are viewed from the side of the face plate substrate 4, light emission is not seen in the regions where the black members 65 to 67 are disposed, and light emission can be seen only in the regions where the light-emitting members 59 to 64 are independently formed.

That is to say, in the case of FIG. 6A, the light-emitting regions of the preset invention are the regions where the light-emitting members 59 and 60 are disposed. On the other hand, in the case of FIGS. 6B and 6C, not the region where the light-emitting members 61 to 64 are disposed but the regions 61*a* to 64*a* where the light-emitting members 61 to 64 are independently formed are the light-emitting regions of the present invention.

Figure 7:
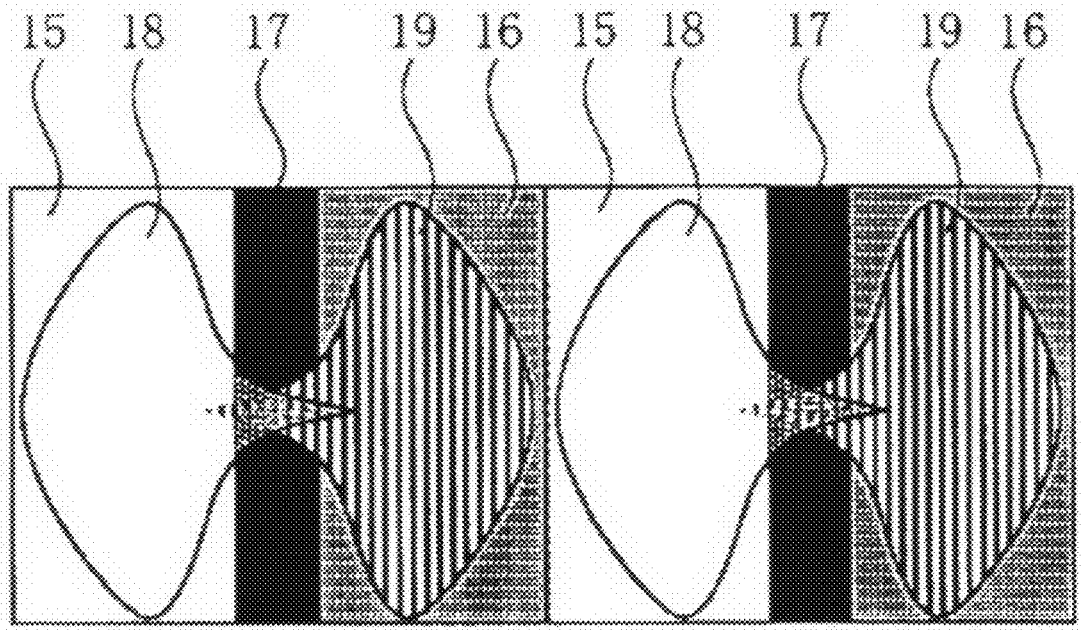
FIG. 7 is a diagram illustrating another positional relationship among the light-emitting members and the black members and the electron-irradiated regions according to the first embodiment.
Figure 8A:
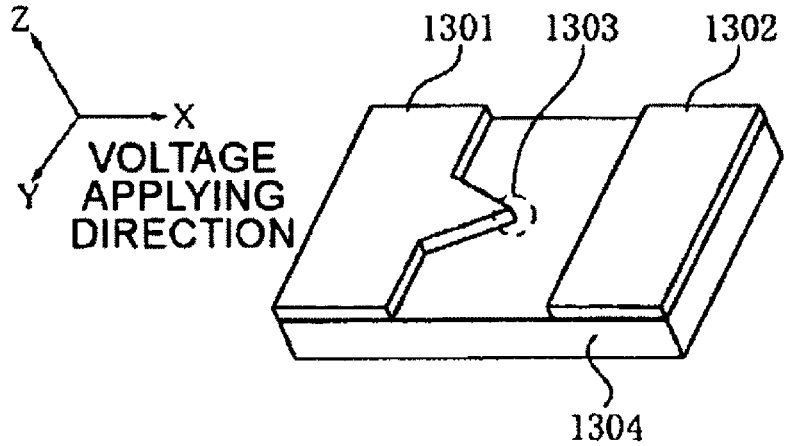
FIGS. 8A to 8C are diagrams illustrating lateral field-emitting devices.
Figure 8B:
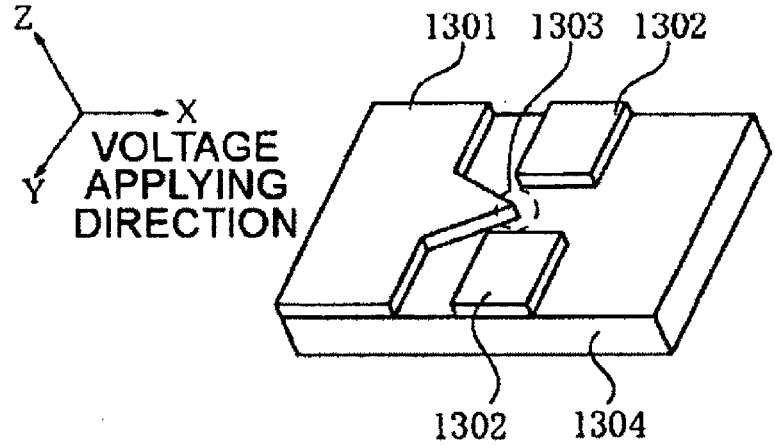
Figure 8C:
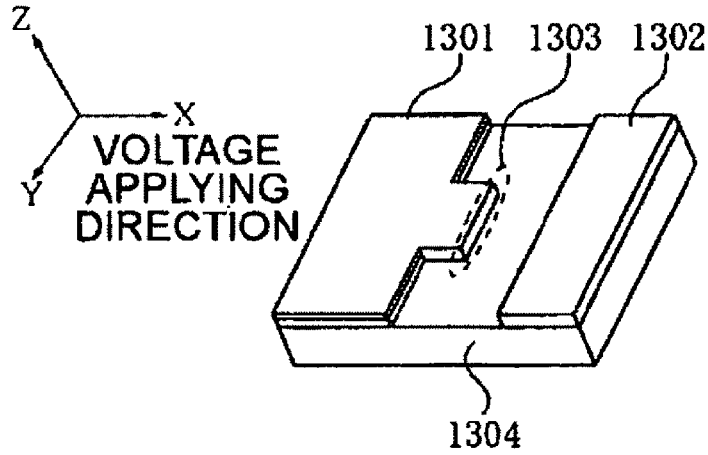

In the first embodiment, the end of the low electron-density side in the electron-irradiated region (hereinafter, "tail of the electron-irradiated region") overlaps a tail of the adjacent electron-irradiated region, and the overlapped portion of the two tails is covered with the black member (see the electron-irradiated regions 18*b* and 18*a* in FIG. 2A). However, the positional relationship among the light-emitting regions and the black members and the electron-irradiated regions of the present invention is not limited to this. For example, the tails of the two electron-irradiated regions do not have to overlap each other. The tails of the electron-irradiated regions do not have to overlap the black member (namely, the entire electron-irradiated region is in the light-emitting region). On the contrary, as shown in FIG. 7, it is preferable that the front ends of the tails of the electron-irradiated regions 18 and 19 exceed the black member 17 to extend up to the adjacent light-emitting members 16 and 15, respectively. In each form, the function and the effect of the present invention can be obtained. However, when the tails of the electron-irradiated regions overlap each other (further, the overlapped portion is larger), the pixel pitch becomes smaller, which is preferable.

The first embodiment describes the fiat type surface conduction electron-emitting device as an example, but the electron-emitting device of the present invention is not limited to this. For example, like a vertical type surface conduction electron-emitting device or a lateral type field-emitting device shown in FIGS. 8A to 8C, a device may emit electrons to a position which is shifted from a position above the electron-emitting device in the vertical direction. In FIGS. 8A to 8C, 1301 denotes a negative pole, 1302 denotes a positive pole, 1303 denotes an electron-emitting portion, and 1304 denotes a substrate.

Spindt type and HIM type electron-emitting devices in which emitted electrons do not scatter on the rear plate but directly reach the face plate may be used. In comparison with the surface conduction electron-emitting device, non-uniformity of the electron density distribution is hardly generated in principle in the case of these electron-emitting devices. However, actually the electron trajectory changes due to the wiring group for matrix driving, so that the non-uniformity is generated. For this reason, the present invention can be applied also to such electron-emitting devices.

In the first embodiment, the electrons emitted from the electron-emitting device reach the light-emitting member above the adjacent electron-emitting device in the vertical direction, but the first embodiment is not limited to this. The electrons emitted from the electron-emitting device 10 advances on the electron trajectory 12 in FIG. 18. At this time, a distance Lef from the position above the electron-emitting device in the vertical direction to the electron landing position can be calculated according to the following formula (1):

$$Lef=2\times K\times Lh\times SQRT(Vf/Va) \quad (1)$$

Lh [m] denotes a distance between the electron-emitting device 10 and the light-emitting member 5, and K denotes a constant which is determined by a type and a shape of the electron-emitting device 10. SQRT (Vf/Va) denotes a square root of Vf/Va.

Therefore, for example, even a configuration in which electrons emitted from an electron-emitting device reach a light-emitting member above the 2nd adjacent electron-emitting device in the vertical direction can achieve the object of the present, if the electron-irradiated regions, light-emitting members, and black members are arranged in the same manner as described in the first embodiment.

In the first embodiment, the following embodiments and comparative example, Va is set to 10 kV, Vf is set to 18V, and Lh is set to 1.6 mm.

Comparative Example

Figure 9A:
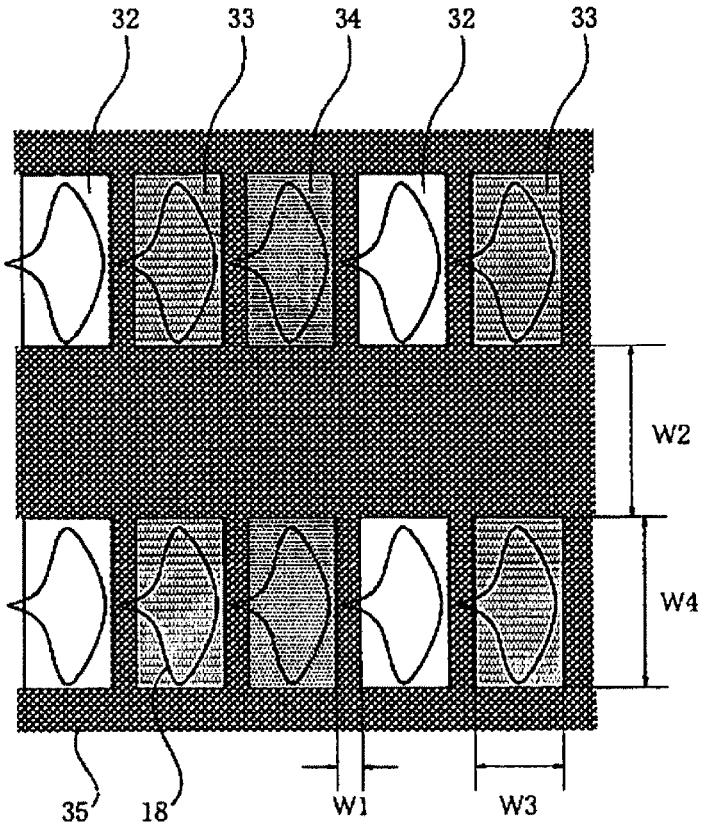
FIG. 9A is a diagram illustrating a configuration of a face plate according to a comparative example.
Figure 9B:
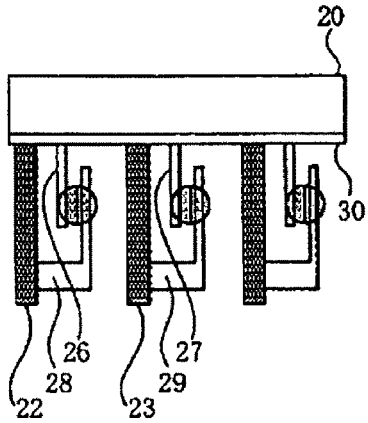
FIG. 9B is a diagram illustrating a configuration of a rear plate.

FIGS. 9A and 9B illustrate the face plate (FIG. 9A) and the rear plate (FIG. 9B) of the conventional image display apparatus as the comparative example. The similar members as those in FIG. 5 are denoted by the similar reference numerals. 18 denotes the electron-irradiated region. 30 denotes an interlayer insulating layer.

In the comparative example, the black member 35 of width W1 is disposed between the light-emitting members 33 and 34 as well as between the light-emitting members 32 and 33. The values of W1 to W4 are equal to those in FIG. 4. As is clear from FIG. 9B, the scan signal electrodes 26 and the information signal electrodes 28 are arranged alternatively in this order from left to right along the X direction. For this reason, the electron-irradiated regions 18 face the uniform direction. In the comparative example, the pitch of one set of red, green and blue light-emitting members in the X direction is 600 μm.

Second Embodiment

Figure 11:
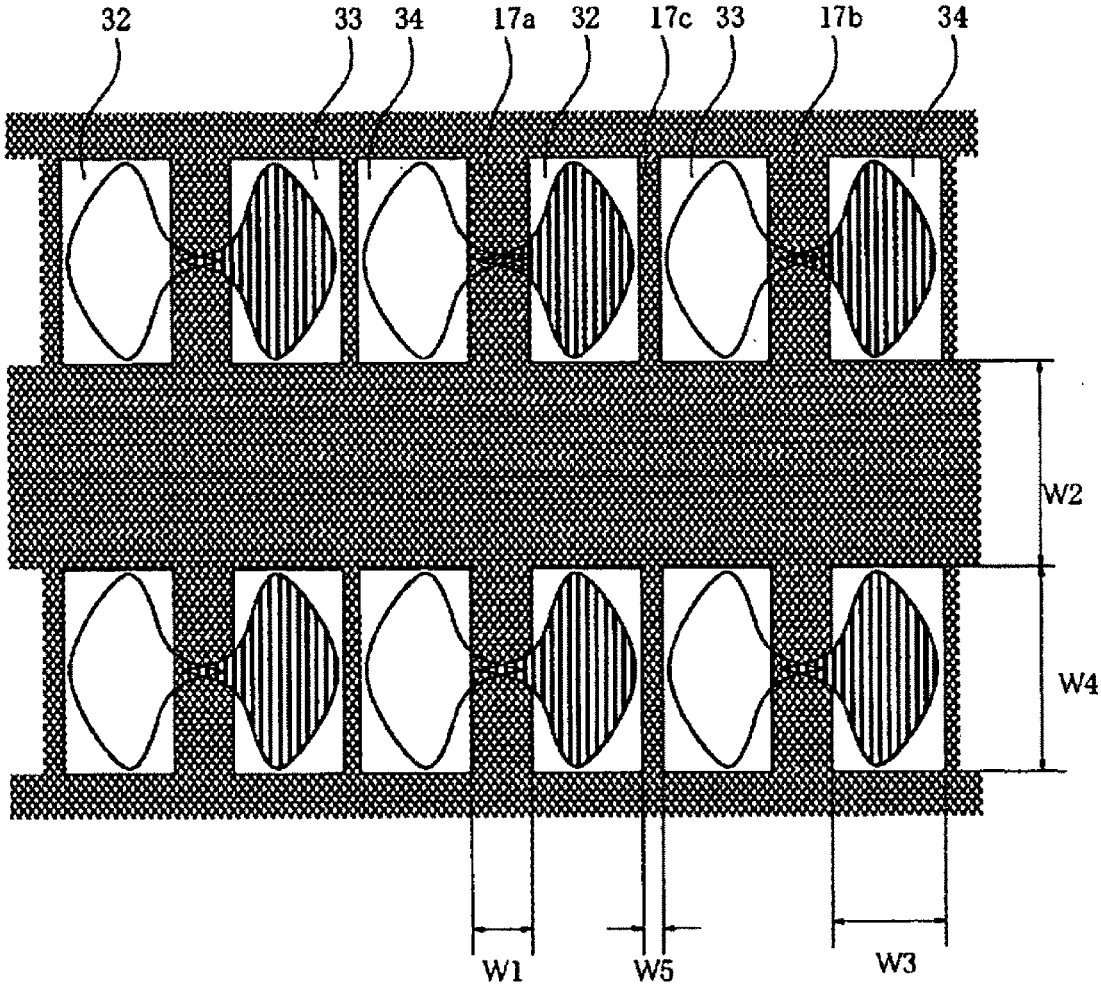
FIG. 11 is a diagram illustrating a configuration of a face plate according to the second embodiment.

FIG. 10A is a configuration diagram illustrating the face plate and the electron-irradiated regions 18*a* to 18*d* in the second embodiment. In FIG. 10A, the same members as those in FIG. 2A are denoted by the same reference numerals. A difference of the second embodiment from the first embodiment is that the black member 17*c* (second black member) is disposed between the first and second light-emitting members 33 and 34. However, as shown in FIGS. 10A and 11, a width W5 of the black member 17*c* is smaller than the width W1 of the black members 17*a* and 17*b* (first black members). The values of W1 to W4 are equal with those in the first embodiment. W5 is set to 20 μm. The pitch of one set of red, green and blue light-emitting members in the X direction in the second embodiment is 555 μm.

The rear plate has the same configuration as that in FIG. 3, and a gap of 20 μm is provided between the information signal wirings 22 and 23.

In the second embodiment, the centroid (geometric center) and the electron-density-weighted center of the first electron-irradiated region 18*a* are in different positions along the first direction (X direction). The centroid (geometric center) and the electron-density-weighted center of the second electron-irradiated region 18*d* are in different positions along the first direction (X direction). In other words, in the second embodiment, the electron-density-weighted center of the first electron-irradiated region 18*a* and the electron-density-weighted center of the second electron-irradiated region 18*d* are in positions which are shifted to directions where they come close from the geometric centers of the electron-irradiated regions 18*a* and 18*d*, respectively. The high electron-density side of the first electron-irradiated region 18*a* (corresponding to a region B' in FIG. 10B) faces the high electron-density side of the second electron-irradiated region 18*d* (corresponding to a region B in FIG. 10B). The first black member 17*a* is disposed on the opposite side of the first light-emitting member 33 from the second light-emitting member 34, and the second black member 17*c* is disposed between the first light-emitting member 32 and the second light-emitting member 34. The third black member 17*b* is disposed on the opposite side of the second light-emitting member 34 from the first light-emitting member 33 (see FIG. 10A). In other words, the first black member 17*a* and the third black member 17*b* are disposed on the low electron-density side of the first electron-irradiated region 18*a* (corresponding to a region A' in FIG. 10B) and the low electron-density side of the second electron-irradiated region 18*d* (corresponding to a region A in FIG. 10B), respectively. As shown in FIG. 11, the width W5 of the second black member 17*c* with respect to the first direction (X direction in the second embodiment is smaller than the width W1 of the first and third black members 17*a* and 17*b*.

When the width W5 of the black member 17*c* between the first light-emitting member 33 and the second light-emitting member 34 is set to be smaller than the width W1 of the black members 17*a* and 17*b*, the black member for width of W1 minus W5 is not required. The pixel pitch is reduced accordingly, so that nigh-definition is enabled.

In the second embodiment, the high electron-density side of the electron-irradiated region 18*a* (corresponding to the region B' in FIG. 10B) does not overlap the high electron-density side of the electron-irradiated region 18*d* (corresponding to the region B in FIG. 10B). The present invention is not, however, limited to this.

Figure 12:
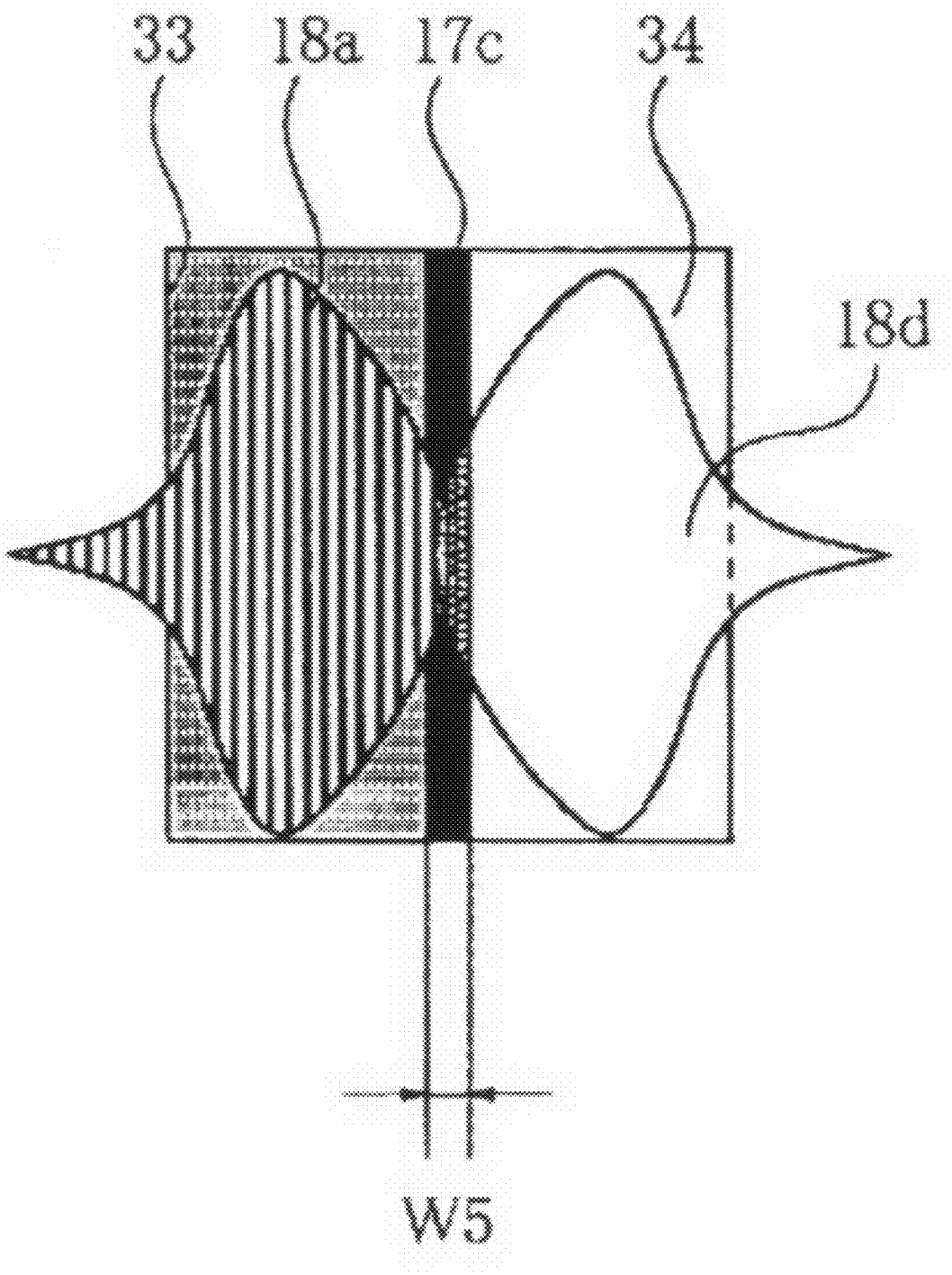
FIG. 12 is a diagram illustrating another positional relationship among the light-emitting members, the black members and the electron-irradiated regions in the second embodiment.

For example as shown in FIG. 12, the high electron-density side of the electron-irradiated region 18*a* (corresponding to the region B' in FIG. 10B) overlap the high electron-density side of the electron-irradiated region 18*d* (corresponding to the region B in FIG. 10B), and the overlapped portion may be covered with the black member 17*c*.

It is preferable that the lowering amount of the luminance due to the coating of the electron-irradiated region with the black member falls within a range of about 0.5 to 5.0%. That is to say, the integral quantity of the electron-irradiation density on the portions covered with the black members 17*a*, 17*b* and 17*c* is about 0.5 to 5.0% with respect to the total integral quantity of the electron-irradiated regions 18*a* and 18*d*.

Third Embodiment

Figure 13:
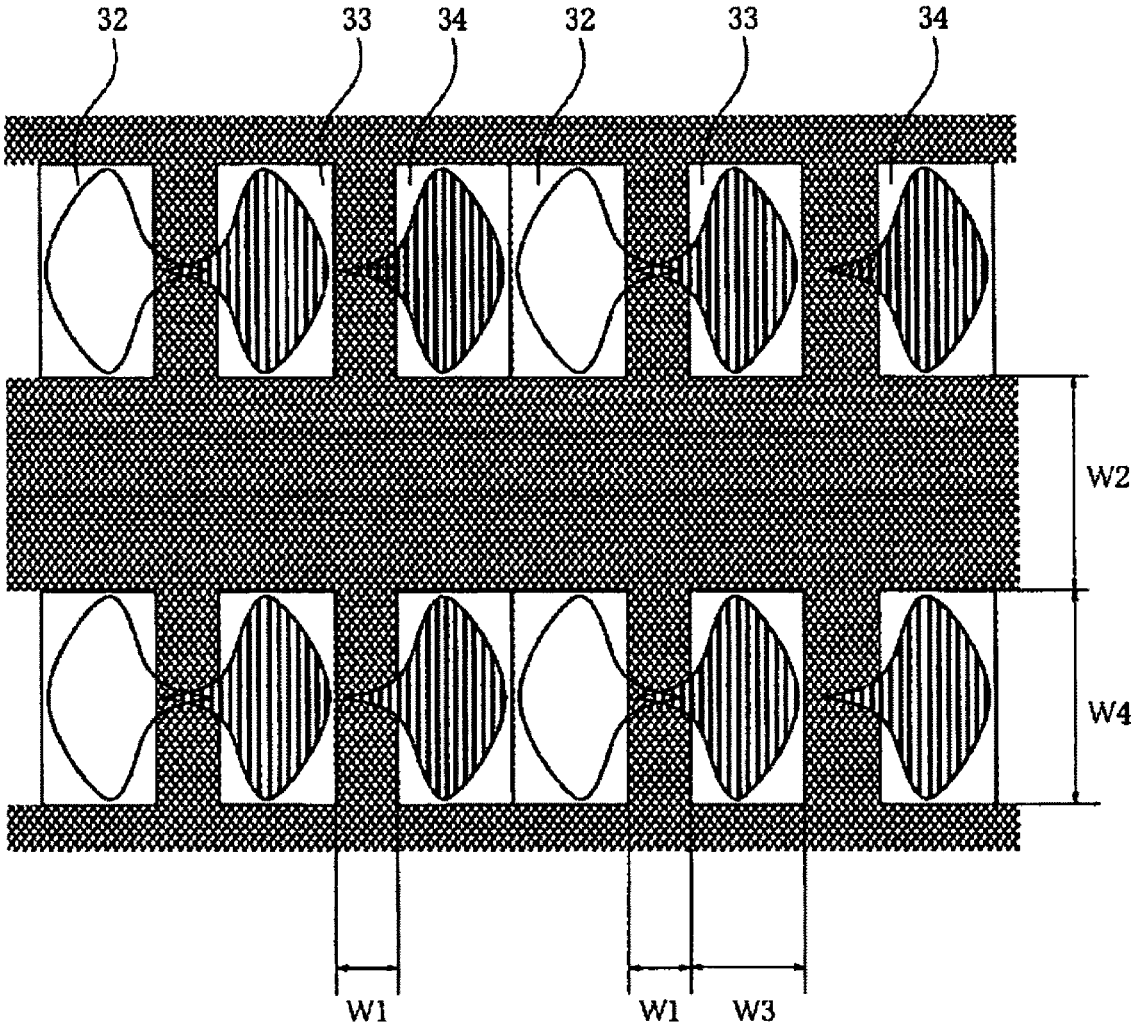
FIG. 13 is a diagram illustrating a configuration of a face plate according to a third embodiment.
Figure 14:
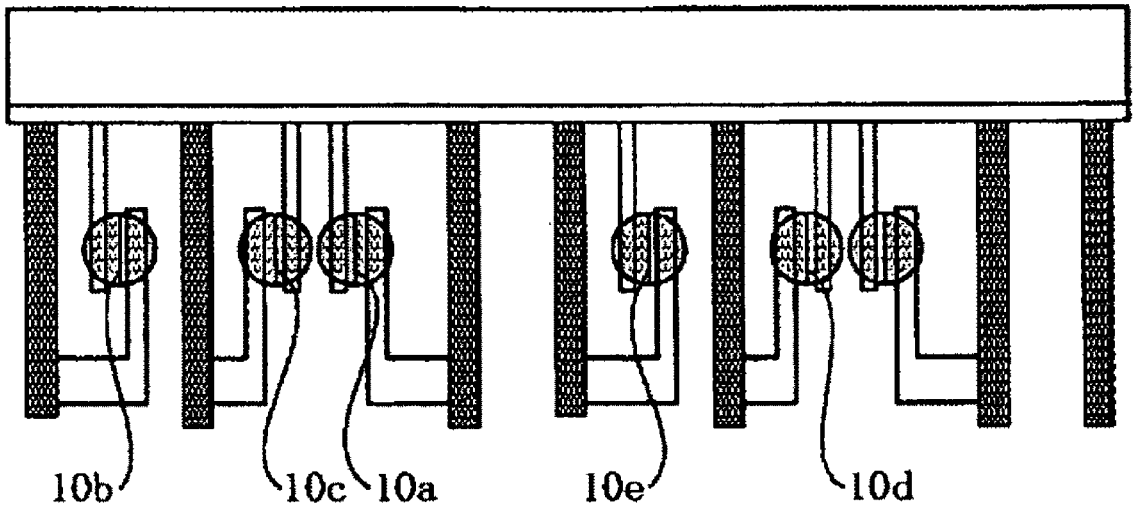
FIG. 14 is a diagram illustrating a configuration of a rear plate according to the third embodiment.

FIG. 13 is a configuration diagram illustrating the face plate and the electron-irradiated regions according to a third embodiment of the present invention. FIG. 14 is a configuration diagram illustrating the rear plate according to the third embodiment. Similarly to the above embodiments, a higher potential than that of the scan signal electrodes is applied to the information signal electrodes at the time of electron emission. The red, green and blue light-emitting members (light-emitting regions) 32 to 34 are arranged in this order in the X direction (row direction). The light-emitting members of uniform color are arranged in the Y direction (column direction). The pitch of one set of red, green and blue light-emitting members in the X direction is 550 μm in the third embodiment.

In the third embodiment, the shape of the electron-irradiated regions formed on the light-emitting members 32 and the shape of the electron-irradiated regions formed on the light-emitting members 33 and 34 are reversed each other. The first electron-emitting device 10*a* emits electrons to the first light-emitting member 34, the second electron-emitting device 10*d* emits electrons to the second light-emitting member 32, and the third electron-emitting device 10*e* emits electrons to the third light-emitting member 33. The electron-emitting devices 10*b* and 10*c* in the drawing correspond to the third electron-emitting device and the second electron-emitting device due to a relationship with the electron-emitting devices not shown.

That is to say, in the third embodiment, the electrons emitted from the first and third electron-emitting devices shift from the position above the electron-emitting devices in the vertical direction to the right direction in the drawing. The electrons emitted from the second electron-emitting device shift from the position above the electron-emitting devices in the vertical direction to the left direction in the drawing. The first, second and third light-emitting members 34, 32 and 33 irradiated with the electrons from the first, second and third electron-emitting devices are disposed in this order along the row direction (X direction). In the third embodiment, the black member is not disposed between the first and second light-emitting members 34 and 32. The black member (first black member) with width W1 is disposed between the second and third light-emitting members 32 and 33. In other words, in the third embodiment, the third light-emitting member 33 is disposed on the opposite side of the first black member from the second light-emitting member 32. A plurality of trios of first, second and third light-emitting members 34, 32 and 33 is arranged in the row direction with no other light-emitting regions.

When the black member is not disposed between the light-emitting members 34 and 32 in such a manner, the black member for width W1 is not required, and the pixel pitch is reduced accordingly so that high definition is enabled. According to the third embodiment, the luminance centroid becomes constant, and thus uniformity of the image display increases.

In the third embodiment, the electrons emitted from the first and third electron-emitting devices shift from the position above the electron-emitting devices in the vertical direction to the right direction in the drawing, and the electrons emitted from the second electron-emitting device shift from the position above the electron-emitting device in the vertical direction to the left direction in the drawing. However, the present invention is not limited to this. That is to say, the electrons emitted from the first and third electron-emitting devices may shift from the position above the electron-emitting devices in the vertical direction to the left side in the drawing, and the electrons emitted from the second electron-emitting device may shift from the position above the electron-emitting device in the vertical direction to the right direction in the drawing.

Fourth Embodiment

Figure 15:
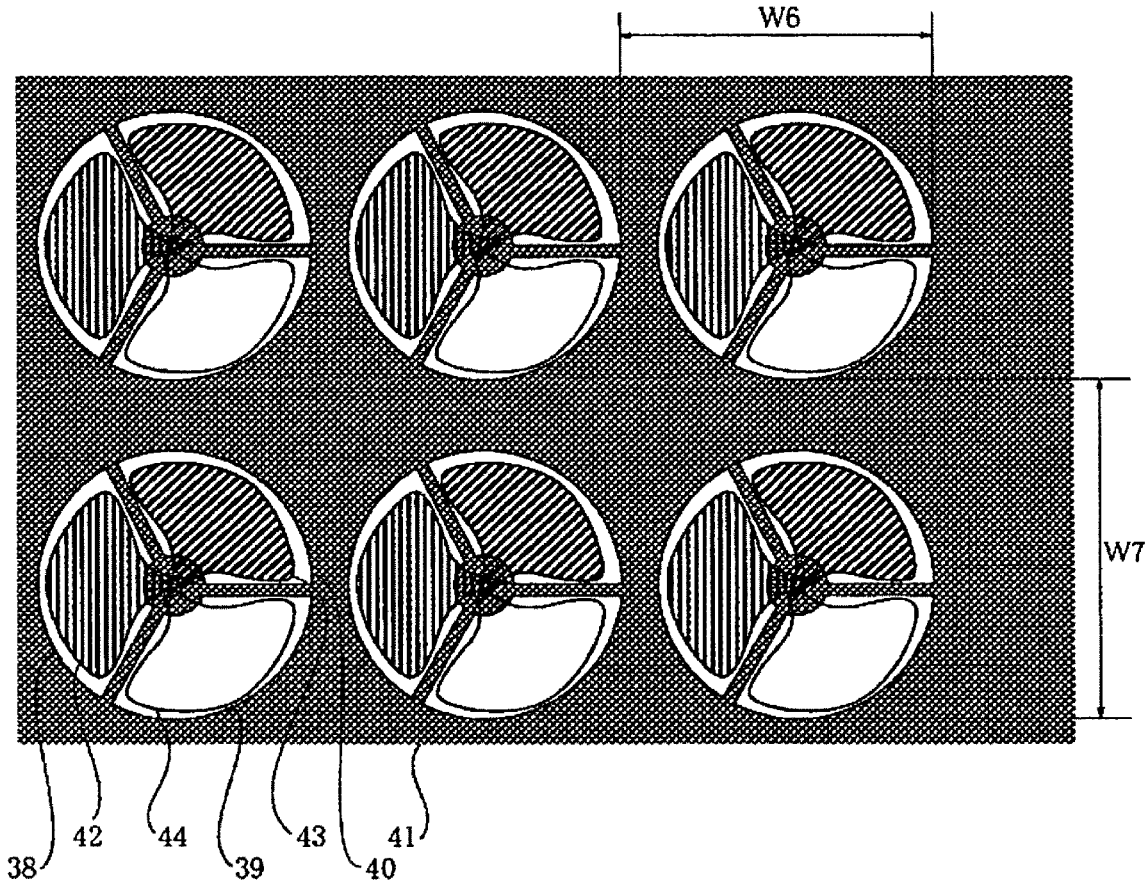
FIG. 15 is a diagram illustrating a configuration of a face plate according to a fourth embodiment.

A fourth embodiment of the present invention is shown in FIG. 15. In FIG. 15, 38 to 40 denote the light-emitting members, 41 denotes the black member, and 42 to 44 denote the electron-irradiated regions corresponding to the light-emitting members 38 to 40. The fan-shaped light-emitting members 38 to 40 are arranged into circularly, and compose pixels of different colors, respectively. The pixel array in FIG. 15 is a so-called a delta array. The black member 41 is arranged at the center among the three light-emitting members 38 to 40. In the fourth embodiment, the ends (tails) on the low electron-density side of the three electron-irradiated regions 42 to 44 overlap one another, and the overlapped portion is covered with the black member 41. In the drawing, a width 6 in the X direction and a width W7 in the Y direction are 450 μm and 600 μm, respectively.

Figure 16:
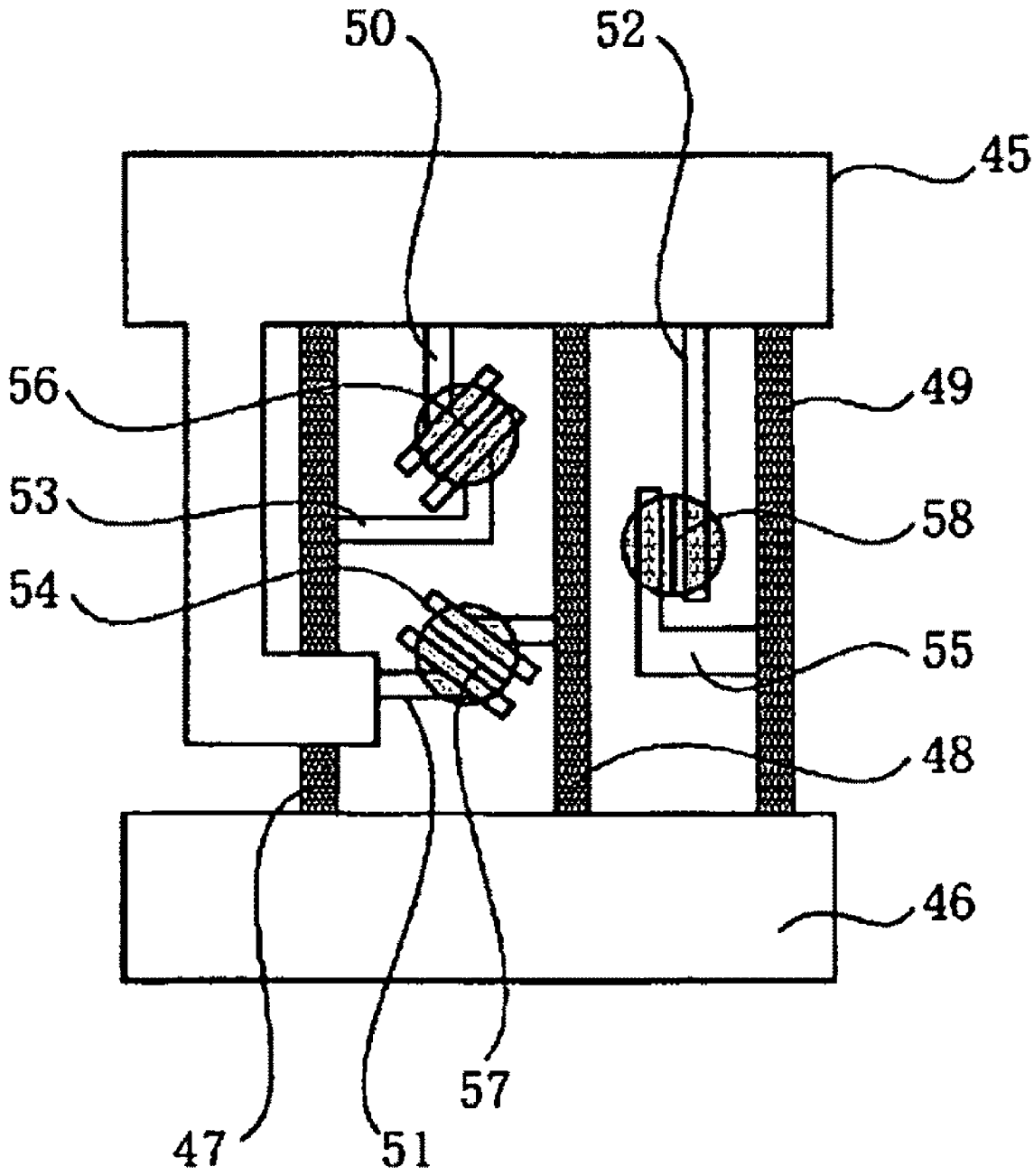
FIG. 16 is a diagram illustrating a configuration of a rear plate according to the fourth embodiment.

FIG. 16 illustrates the arrangement of the rear plate (for one set of the electron-irradiated regions 42 to 44) which realizes the arrangement of the face plate shown in FIG. 15. In FIGS. 16, 45 and 46 denote the scan signal wirings, 47 to 49 denote information signal wirings, 50 to 52 denote scan signal electrodes, 53 to 55 denote the information signal electrodes, and 56 to 58 denote the first to third electron-emitting devices. As not shown, an insulating layer is provided between the scan signal wirings 45 and 46 and the information signal wirings 47 to 49 so as to insulate them. Since the basic operation is similar to those in the first to third embodiments, the description thereof will not be described. A higher potential than that of the scan signal electrodes 50 to 52 is applied to the information signal electrodes 53 to 55 at the time of electron emission.

In the fourth embodiment, the first electron-irradiated region 44 is formed on the face plate by irradiation with electrons emitted from the first electron-emitting device 56 to the first light-emitting portion 39. In the first electron-irradiated region 44, the geometric centroid and the electron-density-weighted center are in different positions along a direction radial about the black member 41. The second electron-irradiated region 43 is formed by irradiation with electrons emitted from the second electron-emitting device 57 to the second light-emitting portion 40, and the third electron-irradiated region 42 is formed by irradiation with electrons emitted from the third electron-emitting device 58 to the third light-emitting portion 38. Similarly in the second and third electron-irradiated regions 43 and 42, the geometric centroid and the electron-density-weighted center are in different positions along a direction radial about the black member 41. Lines which connect the geometric centroids and the electron-density-weighted centers on the respective electron-irradiated regions form an angle of about 120°. The black member 41 is disposed on the low electron-density sides of the first, second and third electron-irradiated regions 44, 43 and 42 (in FIG. 15, the centers of the circular light-emitting members).

The low electron-density sides of the three electron-irradiated regions 42 to 44 overlap and are covered with the black member 41, so that the pixel pitch can be reduced.

Not only the overlapping of the three electron-irradiated regions 42 to 44 described in the fourth embodiment but also a configuration that four or more regions overlap can produce the similar effect according to the shape of the electron-irradiated regions.

<Configuration of the Display Panel >

The configuration and a method of manufacturing the display panel of the image display apparatus to which the present invention can be applied are described below as a concrete example.

Figure 17:
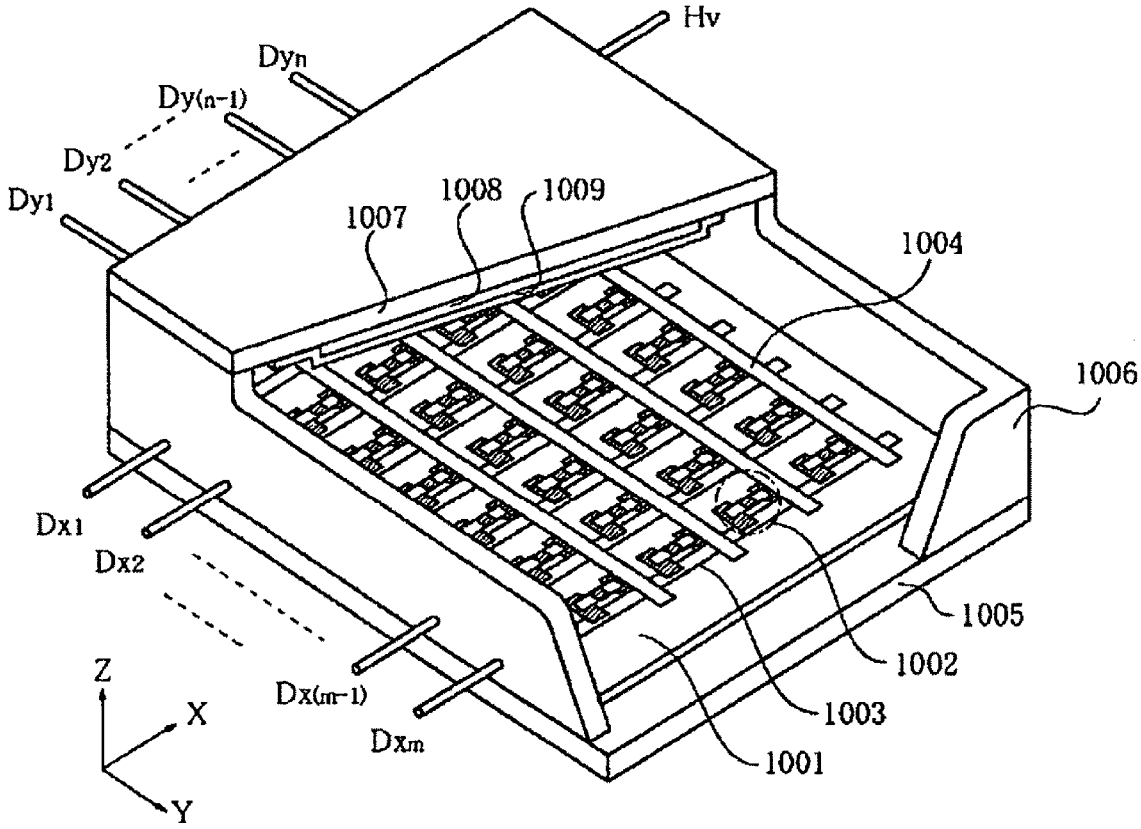
FIG. 17 is a perspective view illustrating a display panel of an image display apparatus to which the present invention can be applied.

FIG. 17 is a perspective view of the display panel used in the embodiments, and illustrates partially cut away of the panel in order to illustrate an internal structure.

In FIG. 17, 1005 denotes the rear plate, 1006 denote a side wall, 1007 denotes the face plate, and members 1005 to 1007 form an airtight container for maintaining a vacuum state inside the display panel. At the time of assembling the airtight container, sealing is necessary in order to maintain sufficient strength and airtightness at the joint portion of the respective members. For example, frit glass as an adhesive is applied to the joint portions, and the joint portions are calcined at 400 to 500° C. for 10 or more minutes in air or nitrogen atmosphere so that the sealing is achieved. A method of evacuating the airtight container is described later.

A substrate 1001 is fixed to the rear plate 1005. The N×M number of cold cathode devices 1002 as electron sources are formed on the substrate 1001. N and M are positive integer numbers of 2 or more, and they are suitably set according to the target number of display pixels. For example, in a display apparatus for display of a high-quality television, it is desirable that 3000 or more is set for N and 1000 or more is set for M. In this embodiment, 3072 is set for N and 1024 is set for M. The N×M number of the cold cathode devices 1002 are arranged on intersection points between simple matrix wirings formed by the M number of row direction wirings 1003 and the N number of column direction wirings 1004.

In the present invention, the substrate 1001 of the electron sources is fixed to the rear plate 1005 of the airtight container. However, when the substrate 1001 of the electron sources has sufficient strength, the substrate 1001 of the electron sources itself may be used as the rear plate of the airtight container.

A fluorescent film 1008 as a light-emitting member which emits light by irradiation with electrons emitted from the electron sources, and a metal back 1009 as an anode electrode are formed on the lower surface of the face plate 1007, so that a fluorescent plate is formed. A phosphor and the metal back 1009 are arranged in a planar manner so as to be opposed to the cold cathode devices 1002. Since the color display apparatus is used in this embodiment, phosphors of three primary colors: red, green blue to be used in the field of CRTs are applied to the fluorescent film 1008. The phosphors of respective colors are applied into a stripe shape, and the black member is provided between the stripes of the phosphors. The black member is provided in order to prevent shift of display colors even if the irradiated position by means of electron beams slightly shifts, prevent reflection of external light so as to prevent deterioration of display contrast, and prevent charging-up of the fluorescent film due to the electron beams. The black member mainly contains graphite, but the other materials may be used as long as they are suitable for the above objects.

The application shape of the phosphors with three primary colors is not limited to the stripe shape array, and they may be applied into a delta array or the other shapes.

A metal back 1009 which is publicly known in the field of CRTs is provided to the surface of the fluorescent film 1008 on the rear plate side. The metal back 1009 is provided in order to improve light utilization ratio by specular reflection of some of light emitted from the fluorescent film 1008, to protect the fluorescent film 1008 against collision of negative ions generated together with the electron beams, to function as an electrode to which an electron beam acceleration voltage applies, and to make the fluorescent film 1008 act as an electrically-conducting path of excited electrons. After the fluorescent film 1008 is formed on the face plate substrate 1007, the surface of the fluorescent film is smoothed, and Al is formed thereon by a vacuum evaporation method so that the metal back 1009 is formed. When a phosphor material for low voltage is used for the fluorescent film 1008, the metal back 1009 is not used.

A transparent electrode using a transparent electrode ITO or the like as a material, not used in the embodiment, may be preferably provided between the face plate substrate 1007 and the fluorescent film 1008 in order to act as an electrode for an acceleration voltage or in order to improve conductivity of the fluorescent film.

Dx1 to Dxm, Dy1 to Dyn and Hv denote electrically connecting terminals of the airtight structure provided for electrically connecting the display panel and an electric circuit, not shown. Dx1 to Dxm are electrically connected to the row direction wirings 1003 of the electron sources, Dy1 to Dyn are electrically connected to the column direction wirings 1004 of the electron sources, and Hv is electrically connected to the metal back 1009 of the face plate.

In order to evacuate the inside of the airtight container, after the airtight container is assembled, an exhaust pipe, not shown, is connected to a vacuum pump, and the inside of the airtight container is exhausted to a degree of vacuum of about $10^{-7}$ [Torr]. Thereafter, the exhaust pipe is sealed, but in order to maintain the degree of vacuum in the airtight container, a getter film (not shown) is formed on a predetermined position in the airtight container just before or after the sealing. The getter film is a film which is formed by heating and depositing a getter material mainly containing Ba by means of a heater or high-frequency heating. The inside of the airtight container is maintained in the degree of vacuum of $1\times10^{-5}$ to $1\times10^{-7}$ [Torr] by an absorbing function of the getter film.

The process for heating the getter material is occasionally executed every time when the degree of vacuum is deteriorated after sealing.

While the present invention has been described with reference to exemplary embodiments, it is to be understood that the invention is not limited to the disclosed exemplary embodiments. The scope of the following claims is to be accorded the broadest interpretation so as to encompass ail such modifications and equivalent structures and functions.

The invention claimed is:

1. An image display apparatus comprising:

first and second light-emitting regions which are arranged in a first direction and have different colors;

a first electron-emitting device corresponding to the first light-emitting region which is a surface conduction electron-emitting device or a lateral field-emission device and is located further from the second light-emitting region than the first light-emitting region with respect to the first direction;

a second electron-emitting device corresponding to the second light-emitting region which is a surface conduction electron-emitting device or a lateral field-emission device and is located further from the first light-emitting region than the second light-emitting region with respect to the first direction;

a first black member which is located on the opposite side of the first light-emitting region from the second light-emitting region; and a second black member which is located between the first and second light-emitting regions, wherein a width of the second black member with respect to the first direction is smaller than a width of the first black member.

2. An image display apparatus according to claim 1, further comprising a face plate on which the first and second light-emitting regions are arranged in the first direction, wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, centroids of the first and second electron-irradiated regions are between the first and second electron-emitting devices with respect to the first direction, and a distance from the centroid of the first electron-irradiated region to the first electron-emitting device is smaller than a distance from the centroid of the first electron-irradiated region to the second electron-emitting device.

3. An image display apparatus comprising:

first and second light-emitting regions which are arranged in a first direction and have different colors;

a first electron-emitting device corresponding to the first light-emitting region which is a surface conduction electron-emitting device or a lateral field-emission device and is located further from the second light-emitting region than the first light-emitting region with respect to the first direction;

a second electron-emitting device corresponding to the second light-emitting region which is a surface conduction electron-emitting device or a lateral field-emission device and is located further from the first light-emitting region than the second light-emitting region with respect to the first direction; and a first black member which is located on the opposite side of the first light-emitting region from the second light-emitting region, wherein the first and second light-emitting regions are directly adjacent with no black member therebetween.

4. An image display apparatus according to claim 3, further comprising a face plate on which the first and second light-emitting regions are arranged in the first direction, wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, centroids of the first and second electron-irradiated regions are between the first and second electron-emitting devices with respect to the first direction, and a distance from the centroid of the first electron-irradiated region to the first electron-emitting device is smaller than a distance from the centroid of the first electron-irradiated region to the second electron-emitting device.

5. An image display apparatus comprising:

a face plate;

first and second light-emitting regions which are arranged on the face plate in a first direction and have different colors;

first and second electron-emitting devices corresponding to the first and second light-emitting regions respectively;

a first black member which is located on the opposite side of the first light-emitting region from the second light-emitting region; and a second black member which is located between the first and second light-emitting regions, wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, a centroid and an electron-density-weighted center of the first electron-irradiated region are in different positions along the first direction, a centroid and an electron-density-weighted center of the second electron-irradiated region are in different positions along the first direction, high electron-density sides of the first and second electron-irradiated regions face each other; and a width of the second black member with respect to the first direction is smaller than a width of the first black member.

6. An image display apparatus comprising:

a face plate;

first and second light-emitting regions which are arranged on the face plate in a first direction and have different colors;

first and second electron-emitting devices corresponding to the first and second light-emitting regions respectively; and a first black member which is located on the opposite side of the first light-emitting region from the second light-emitting region;

wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, a centroid and an electron-density-weighted center of the first electron-irradiated region are in different positions along the first direction, a centroid and an electron-density-weighted center of the second electron-irradiated region are in different positions along the first direction, high electron-density sides of the first and second electron-irradiated regions face each other; and the first and second light-emitting regions are directly adjacent with no black member therebetween.

7. An image display apparatus according to claim 1, wherein the first black member is located so as to overlap the first electron-irradiated region.

8. An image display apparatus according to claim 1, wherein a plurality of pairs of the first and second light-emitting regions are aligned in the first direction with no other light-emitting regions between the adjacent pairs.

9. An image display apparatus according to claim 1, further comprising a third light-emitting region located on the opposite side of the first black member from the second light-emitting region, wherein a plurality of trios of the first, second and third light-emitting regions are aligned in the first direction with no other light-emitting regions between the adjacent trios.

10. An image display apparatus comprising:

a face plate;

first, second and third light-emitting regions which are arranged on the face plate in a circular form and have different colors;

first, second and third electron-emitting devices corresponding to the first, second and third light-emitting regions respectively; and a black member which is located at a center of the first, second and third light-emitting regions;

wherein a first electron-irradiated region is formed on the face plate by irradiation with electrons emitted toward the first light-emitting region from the first electron-emitting device, a second electron-irradiated region is formed on the face plate by irradiation with electrons emitted toward the second light-emitting region from the second electron-emitting device, a third electron-irradiated region is formed on the face plate by irradiation with electrons emitted toward the third light-emitting region from the third electron-emitting device, a centroid and an electron-density-weighted center of the first electron-irradiated region are in different positions along a direction radial about the black member, a centroid and an electron-density-weighted center of the second electron-irradiated region are in different positions along a direction radial about the black member, a centroid and an electron-density-weighted center of the third electron-irradiated region are in different positions along a direction radial about the black member, and the black member is located on low electron-density sides of the first, second and third electron-irradiated regions.

11. An image display apparatus according to claim 10, wherein the black member is located so as to overlap the first, second and third electron-irradiated regions.

12. An image display apparatus according to claim 3, wherein the first black member is located so as to overlap the first electron-irradiated region.

13. An image display apparatus according to claim 3, wherein a plurality of pairs of the first and second light-emitting regions are aligned in the first direction with no other light-emitting regions between the adjacent pairs.

14. An image display apparatus according to claim 3, further comprising a third light-emitting region located on the opposite side of the first black member from the second light-emitting region, wherein a plurality of trios of the first, second and third light-emitting regions are aligned in the first direction with no other light-emitting regions between the adjacent trios.

15. An image display apparatus according to claim 5, wherein the first black member is located so as to overlap the first electron-irradiated region.

16. An image display apparatus according to claim 5, wherein a plurality of pairs of the first and second light-emitting regions are aligned in the first direction with no other light-emitting regions between the adjacent pairs.

17. An image display apparatus according to claim 5, further comprising a third light-emitting region located on the opposite side of the first black member from the second light-emitting region, wherein a plurality of trios of the first, second and third light-emitting regions are aligned in the first direction with no other light-emitting regions between the adjacent trios.

18. An image display apparatus according to claim 6, wherein the first black member is located so as to overlap the first electron-irradiated region.

19. An image display apparatus according to claim 6, wherein a plurality of pairs of the first and second light-emitting regions are aligned in the first direction with no other light-emitting regions between the adjacent pairs.

20. An image display apparatus according to claim 6, further comprising a third light-emitting region located on the opposite side of the first black member from the second light-emitting region, wherein a plurality of trios of the first, second and third light-emitting regions are aligned in the first direction with no other light-emitting regions between the adjacent trios.

* * * * *